US009901806B2

(12) United States Patent
Fritschi

(10) Patent No.: US 9,901,806 B2
(45) Date of Patent: Feb. 27, 2018

(54) AUTOMATIC HEEL UNIT WITH WALKING CONFIGURATION

(71) Applicant: Fritschi AG—Swiss Bindings, Reichenbach im Kandertal (CH)

(72) Inventor: Andreas Fritschi, Thun (CH)

(73) Assignee: FRITSCHI AG—SWISS BINDINGS, Reichenbach Im Kandertal (CH)

( * ) Notice: Subject to any disclaimer, the term of this patent is extended or adjusted under 35 U.S.C. 154(b) by 0 days.

(21) Appl. No.: 15/411,578

(22) Filed: Jan. 20, 2017

(65) Prior Publication Data

US 2017/0209769 A1 Jul. 27, 2017

(30) Foreign Application Priority Data

Jan. 22, 2016 (EP) ..... 16152428

(51) Int. Cl.
*A63C 9/08* (2012.01)
*A63C 7/10* (2006.01)
(Continued)

(52) U.S. Cl.
CPC ..... *A63C 9/0807* (2013.01); *A63C 7/102* (2013.01); *A63C 7/1073* (2013.01); *A63C 9/001* (2013.01);
(Continued)

(58) Field of Classification Search
CPC ..... A63C 9/08; A63C 9/00; A63C 9/084
See application file for complete search history.

(56) References Cited

U.S. PATENT DOCUMENTS 4,243,245 A 1/1981 Krob
4,428,597 A 1/1984 Wittmann et al.
(Continued)

FOREIGN PATENT DOCUMENTS

CH 706 664 A1 12/2013
DE 29 00 239 A1 7/1979
(Continued)

*Primary Examiner* — John D Walters
*Assistant Examiner* — James J Triggs
(74) *Attorney, Agent, or Firm* — Birch, Stewart, Kolasch & Birch, LLP

(57) ABSTRACT

The invention relates to an automatic heel unit for a ski binding, in particular a ski-touring binding, comprising a heel retainer, for retaining a ski boot in a heel area of the ski boot, and a heel retainer support on which the heel retainer is mounted so as to be movable along an adjustment path relative to the heel retainer support. The automatic heel unit has a holding configuration in which the heel retainer is located in a holding setting and the heel retainer can interact with the heel area of the ski boot held in the ski binding in such a way that the heel area of the ski boot is held in a lowered position. Furthermore, the automatic heel unit has a walking configuration in which the heel retainer is located in a walking setting and the heel area of the ski boot held in the ski binding is freed from the heel retainer and can be lowered toward the ski without being locked by the heel retainer in the lowered position. The heel retainer in its walking setting is located farther to the rear than in its holding setting and is movable from its walking setting to its holding setting and back again along a first area of the adjustment path. Starting from its walking setting, the heel retainer is movable along the first area of the adjustment path, beyond its holding setting, upward from the first area of the adjustment path into a second area of the adjustment path separate from the first area of the adjustment path and
(Continued)

adjoining the first area of the adjustment path, and back again.

18 Claims, 6 Drawing Sheets

(51) Int. Cl.
*A63C 9/00* (2012.01)
*A63C 9/084* (2012.01)

(52) U.S. Cl.
CPC ..... *A63C 9/006* (2013.01); *A63C 9/007* (2013.01); *A63C 9/0842* (2013.01); *A63C 9/0846* (2013.01)

(56) References Cited

U.S. PATENT DOCUMENTS

| | | | | |
|---|---|---|---|---|
| 2001/0011801 | A1* | 8/2001 | Dennis ..... | A63C 10/10 280/14.21 |
| 2015/0297974 | A1 | 10/2015 | Brandl | |

FOREIGN PATENT DOCUMENTS

| | | | |
|---|---|---|---|
| DE | 10 2004 040 788 | A1 | 11/2005 |
| DE | 10 2012 208 915 | A1 | 11/2013 |
| DE | 10 2014 004 874 | A1 | 10/2015 |
| EP | 2 656 884 | A1 | 10/2013 |
| EP | 2 762 209 | A2 | 8/2014 |
| EP | 2 762 211 | A2 | 8/2014 |
| WO | WO 96/23559 | A1 | 8/1996 |
| WO | WO 2009/105866 | A1 | 9/2009 |

* cited by examiner

AUTOMATIC HEEL UNIT WITH WALKING CONFIGURATION

TECHNICAL FIELD

The invention relates to an automatic heel unit for a ski binding, in particular a ski-touring binding, comprising a heel retainer, for retaining a ski boot in a heel area of the ski boot, and a heel retainer support. The heel retainer is mounted on the heel retainer support so as to be movable along an adjustment path relative to the heel retainer support. The automatic heel unit has a holding configuration in which the heel retainer is located in a holding setting and the heel retainer can interact with the heel area of the ski boot held in the ski binding in such a way that the heel area of the ski boot is held in a lowered position. Furthermore, the automatic heel unit has a walking configuration in which the heel retainer is located in a walking setting and the heel area of the ski boot held in the ski binding is freed from the heel retainer and can be lowered toward the ski without being locked by the heel retainer in the lowered position.

PRIOR ART

Automatic heel units of the technical field mentioned at the outset are known. Said automatic heel units, in a holding configuration, have the task of guaranteeing reliable fixing of the heel area of the ski boot to the ski. In order for the safety of the skier to be increased, some automatic heel units of this kind, starting from the holding configuration, permit a safety release in which the heel area of the ski boot is freed. This may be a safety release in the forward direction, for example, or a lateral safety release. In either case, the term "safety release" means that the automatic heel unit frees the heel area of the ski boot if the energy of an impact on the ski boot, the ski binding or the ski exceeds a predetermined value. It is immaterial whether the automatic heel unit, after freeing the ski boot, is located in the holding configuration or in another configuration. However, in the event of impacts with an energy that does not exceed this value, the automatic heel unit keeps the heel area of the ski boot locked.

Moreover, the type of tasks to be assumed by an automatic heel unit generally depends on the function that the ski binding, to which the automatic heel unit belongs, is intended to fulfill. For example, downhill ski bindings are only used for downhill skiing and for skiing on ski lifts. By contrast, ski-touring bindings are additionally also used for walking on skis, in particular for climbing with the aid of climbing skins which are fastened to the skis. By contrast, cross-country bindings are used for cross-country skiing, and Telemark bindings are used for skiing using the Telemark technique. Of these ski bindings, downhill ski bindings have only to guarantee reliable fixing of the ski boot to the ski in a so-called holding position and to enable stepping into the ski binding in a so-called step-in position. or release position. As opposed to this, cross-country and Telemark bindings generally have only to keep the ski boot pivotable about an axle that is oriented in a direction transverse to the ski, and to enable stepping into the ski binding. By contrast, ski-touring bindings, like downhill ski bindings, have to guarantee reliable fixing of the ski boot to the ski in the holding position, and to enable stepping into the ski binding. Additionally, however, said ski-touring bindings, for walking on skis and/or for climbing, have to be able to hold the ski boot so that it is pivotable about an axle that is oriented in a direction transverse to the ski. For this purpose, ski-touring bindings have a walking position in which the ski boot, as is the case in cross-country bindings and Telemark bindings, is pivotable about an axle that is oriented in a direction transverse to the ski, and is liftable from the ski in the heel area, as a result of which an articulated movement between the ski boot and the ski is permitted for walking. Since there are various designs and types of ski-touring bindings, the automatic heel unit in the walking position of a ski-touring binding may be located in different configurations depending on the design and type of the ski-touring binding. For example, it may be located in its holding configuration, in its step-in configuration, in a release configuration or in a walking configuration.

If a holding position is additionally desired in the case of a cross-country binding and Telemark binding, then such a cross-country and/or Telemark binding additionally requires an automatic heel unit by means of which the ski boot in the heel area thereof can be locked as it is lowered toward the ski, and which can free the heel area of the ski boot for walking in the walking position of the cross-country and/or Telemark binding.

For their part, ski-touring bindings may be subdivided into three types. The first type of ski-touring binding comprises a ski boot carrier on which the ski boot is held by way of a front jaw and by an automatic heel unit. Here, the ski boot carrier, in the walking position of the ski-touring binding, together with the ski boot that is held therein, is pivotable in relation to the ski, while the automatic heel unit is located in its holding position and locks the heel area of the ski boot when lowered toward the ski boot carrier. By contrast, in the holding position of the ski-touring binding, the ski boot carrier is locked in an orientation that is substantially parallel to the ski, as a result of which the ski boot that is held on the ski boot carrier is also correspondingly fixed to the ski. Here, the automatic heel unit is again located in its holding configuration and locks the heel area of the ski boot lowered toward the ski boot carrier. For example, a representative version of this first type of ski-touring binding is described in WO 96/23559 A1 (Fritschi AG Apparatebau). By contrast, the second type of ski-touring binding is based on ski boots having rigid soles. In the case of these ski-touring bindings, the ski boot in the toe area thereof is mounted pivotably in an automatic front unit which is fixedly fitted to the ski. In this case, the automatic heel unit is fixedly attached to the ski at a spacing from the automatic front unit that is adapted to the length of the ski boot sole. In the holding position of the ski-touring binding, it is located in its holding configuration and locks the ski boot in the heel area. By contrast, in the walking position of the ski-touring binding, the automatic heel unit is located in its walking configuration. In this configuration, the heel of the ski boot is freed from the automatic heel unit, such that the ski boot can be lifted from the ski and can be pivoted about the bearing on the automatic front unit. It is immaterial whether this walking configuration at the same time corresponds or not to a step-in configuration or release configuration with which the automatic heel unit is provided if need be. For example, a representative version of this type of ski-touring binding is described in EP 2 762 211 A2 (Marker Deutschland GmbH). The third type of ski-touring binding, like the first type, comprises a ski boot carrier on which the ski boot is held in the walking position. For this purpose, a binding jaw is provided at the front on the ski boot carrier, while only a holding element is provided at the rear on the ski boot carrier. An automatic heel unit which is able to fix the heel of the ski boot to the ski in the holding position of the ski-touring binding is not arranged on the ski boot carrier but directly on the ski. Therefore, in this third type of ski-touring binding, the ski boot, in the walking position, is fixed to the ski boot carrier by the front binding jaw and by the holding element, while the automatic heel unit is located in its walking configuration. By contrast, in the holding position of the ski-touring binding, the ski boot is held by the front binding jaw and by the automatic heel unit, located in the holding configuration, the sole of the ski boot being oriented substantially parallel to the ski. For example, a representative version of this type of ski-touring binding is described in CH 706 664 A1 (Fritschi AG-Swiss Bindings).

Thus, automatic heel units which have a holding configuration and a walking configuration, and optionally a release configuration or step-in configuration, are needed in the case of ski-touring bindings of the second and third types, and optionally also in the case of cross-country or Telemark bindings.

An example of an automatic heel unit which has a holding configuration and a walking configuration is described in DE 10 2014 004 874 A1 (Zoor). This automatic heel unit comprises a heel retainer which is mounted so as to be rotatable horizontally about an axle oriented in a direction transverse to the ski. In the holding configuration of the automatic heel unit, the heel retainer is located in a holding setting. To adjust the automatic heel unit to a walking configuration, the heel retainer is pivoted upward and rearward about the axle to its walking setting. In this walking setting, the heel retainer is pivoted out of the path of movement of the heel area of the ski boot, such that the ski boot can be lowered as far as the ski during walking.

Such automatic heel units have the disadvantage that their heel retainer is located upward and to the rear in the walking settings. As a result, such automatic heel units take up a large volume in the walking configuration and, consequently, do not have a compact construction.

Regardless of the bulky construction, some automatic heel units additionally comprise a ski brake in order to prevent unintentional sliding of the ski when the ski boot is not held in the automatic heel unit. Such a ski brake is described, for example, in WO 2009/105866 A1 (G3 Genuine Guide Gear Inc). The disclosed ski brake comprises a tread surface as actuation element, and two free arms. The two free arms are each arranged laterally of the ski, in a vertical plane oriented in the longitudinal direction of the ski, and can be arranged substantially parallel to or at an angle to the longitudinal axis of the ski. The arms are mounted on the automatic heel unit in such a way as to be pivotable about an axle oriented in the transverse direction of the ski. When the arms are pivoted about this axle, the tread surface is moved upward away from the ski and the two free arms on both sides of the ski are pivoted downward past the sliding surface of the ski. In this way, the ski brake is located in a braking position. By contrast, when the tread surface is pressed toward the ski, the two free arms are pivoted upward, such that they no longer extend downward past the sliding surface of the ski. In this way, the ski brake is located in a travel position. To ensure that the ski brake is moved to the braking position when a space above the tread surface is free and the tread surface can be moved upward away from the ski, the ski brake is pretensioned by a spring from the travel position to the braking position. Therefore, in the holding configuration of the automatic heel unit, the ski brake is moved to the braking position when no ski boot is held in the automatic heel unit and prevents the tread surface from moving upward. By contrast, in the walking configuration of the automatic heel unit, a hook suspended in the tread surface is able to keep the ski brake in the travel position despite the pretensioning to the braking position. This prevents the ski brake from being moved to the braking position as soon as the heel of the ski boot is lifted upward from the automatic heel unit during walking. To ensure that this hook frees the ski brake in the holding configuration of the automatic heel unit, the hook is moved to a deactivated position through the adjustment of the automatic heel unit from the walking configuration to the holding configuration.

Such ski brakes have the disadvantage that the ski brake takes up a large volume and, consequently, cannot have a compact construction.

For describing ski-binding systems, a (fictitious) ski is often used as a reference system, it being assumed that the binding is mounted on this ski. This custom is adopted in the present text. Thus, the expression "longitudinal direction of the ski" means along the orientation of the longitudinal axis of the ski. Similarly, "parallel to the ski" means, for an elongate object, oriented along the longitudinal axis of the ski. For a planar object, by contrast, the expression "parallel to the ski" means oriented parallel to the sliding surface of the ski. Furthermore, the expression "transverse direction of the ski" is intended to mean a direction transverse to the longitudinal direction of the ski, although it need not necessarily be oriented precisely at right angles to the longitudinal axis of the ski. Its orientation may also deviate slightly from a right angle. The expression "center of the ski" in turn means a center of the ski when seen in the transverse direction of the ski, while the expression "fixed to the ski" means non-movable in relation to the ski. Moreover, it should be noted that certain expressions that do not contain the word "ski" also refer to the reference system of the (fictitious) ski. Thus, the expressions "front", "rear", "top", "bottom" and "laterally" refer to "front", "rear", "top", "bottom" and "laterally" with respect to the ski. Likewise, terms such as "horizontal" and "vertical" also refer to the ski, wherein "horizontal" means lying in a plane that is parallel to the ski, and "vertical" means being oriented so as to be perpendicular to this plane. By contrast, "height" refers to the distance, measured in the vertical direction, from an upper edge of the ski.

Moreover, in the present description, comparisons of the position of the heel retainer in different settings of the heel retainer refer to the center of gravity of the heel retainer. The center of gravity is to be understood as the mass-weighted average of the positions of the points of mass of the heel retainer. For example, the statement that the heel retainer in one setting is located farther rearward or farther down than in another setting denotes that the center of gravity of the heel retainer in this setting is located farther rearward or farther down than in the other setting.

DESCRIPTION OF THE INVENTION

The object of the invention is to make available an automatic heel unit which is part of the technical field mentioned at the outset and which has a compact construction.

The object is achieved by the features of claim 1. According to the invention, the heel retainer of the automatic heel unit in its walking setting is located farther rearward than in its holding setting. Moreover, the heel retainer is movable from its walking setting to its holding setting and back again along a first area of the adjustment path and, starting from its walking setting, the heel retainer is movable along the first area of the adjustment path, beyond its holding setting, upward from the first area of the adjustment path into a second area of the adjustment path separate from the first area of the adjustment path and adjoining the first area of the adjustment path, and back again.

The adjustment path corresponds to the path that can be covered by the heel retainer relative to the heel retainer support. The indication of a position of the heel retainer on the adjustment path relates here to the position of the center of gravity of the heel retainer on the adjustment path. The indication of a setting of the heel retainer on the adjustment path likewise relates to the position of the center of gravity of the heel retainer on the adjustment path but can also in addition include the orientation of the heel retainer relative to the heel retainer support. A movement of the heel retainer on the adjustment path, which includes a change of position of the heel retainer within the adjustment path, means that the heel retainer is moved with its center of gravity in accordance with the stated change of position relative to the heel retainer support. The indication of a movement of the heel retainer, for example "upward", accordingly means a movement of the heel retainer in which the center of gravity of the heel retainer is moved upward. The adjustment path of the heel retainer can be linear or non-linear or can have both linear parts and non-linear parts. Moreover, the first area of the adjustment path and the second area of the adjustment path can be linear or non-linear independently of each other or can have linear and non-linear parts. "Linear" means that the center of gravity of the heel retainer is moved along a line relative to the heel retainer support when the heel retainer is moved relative to the heel retainer support. It is immaterial here whether the heel retainer is additionally pivoted relative to the heel retainer support or not and thus does or does not change its orientation relative to the heel retainer support. By contrast, "non-linear" means that the center of gravity of the heel retainer does not move relative to the heel retainer support when the heel retainer is moved relative to the heel retainer support. This is the case, for example, when the heel retainer is rotated about its center of gravity relative to the heel retainer support. Moreover, the linear parts of the first area of the adjustment path and of the second area of the adjustment path can be rectilinear or curved independently of each other or can each have both rectilinear and curved portions.

In the walking configuration, the heel area of the ski boot held in the ski binding is freed from the heel retainer and can be lowered toward the ski without being locked by the heel retainer in the lowered position. Accordingly, the heel area of the ski boot held in the ski binding can be lowered toward the ski until it is supported in a lowered position either by an element of the automatic heel unit or by the ski and is prevented from lowering any farther. However, the ski boot is not locked in the lowered position by the heel retainer and instead can be lifted upward again free from the automatic heel unit or ski.

Starting from the walking setting, the heel retainer is movable along the first area of the adjustment path, beyond its holding setting, upward from the first area of the adjustment path into a second area of the adjustment path separate from the first area of the adjustment path and adjoining the first area of the adjustment path, and back again. Here, "upward" means that the heel retainer, directly after the transition from the first area to the second area of the adjustment path, is movable upward away from the ski. It is immaterial here whether the movement of the heel retainer directly after the transition from the first area to the second area of the adjustment path additionally has or does not have a component lying in a plane parallel to the ski. It is also immaterial whether the heel retainer can already be moved upward in the first area of the adjustment path or can only be moved upward in the second area of the adjustment path. However, starting from the walking setting, the heel retainer is preferably movable along the first area of the adjustment path, beyond its holding setting, upward from the first area of the adjustment path substantially rectilinearly into a second area of the adjustment path separate from the first area of the adjustment path and adjoining the first area of the adjustment path, and back again.

In the solution according to the invention, starting from the walking setting, the heel retainer is movable along the first area of the adjustment path, beyond its holding setting, upward from the first area of the adjustment path into a second area of the adjustment path separate from the first area of the adjustment path and adjoining the first area of the adjustment path, and back again. Here "separate" means that the second area of the adjustment path is formed without overlapping the first area of the adjustment path. When the heel retainer is thus moved along the second area of the adjustment path, this movement is not at the same time identical to a movement of the heel retainer along a portion of the first area of the adjustment path. However, the second area of the adjustment path is adjacent to the first area of the adjustment path. This means that the second area of the adjustment path continuously adjoins the first area of the adjustment path. In this way, the heel retainer is movable in a continuous movement profile from the first area of the adjustment path into the second area of the adjustment path, and back again.

The advantage of the solution according to the invention is that the heel retainer is located farther to the rear in its walking setting than in its holding setting. This allows the automatic heel unit to be constructed in such a way that it also takes up little space in the walking configuration. On the one hand, this enhances the comfort of the skier when walking with the skis, when the automatic heel unit is located in the walking configuration. On the other hand, however, it also allows the automatic heel unit to be constructed more simply, such that, when walking, less snow can get into the automatic heel unit and freeze and thus block the mechanism of the automatic heel unit.

Moreover, the solution according to the invention affords the advantage that the heel retainer, in its walking setting, can be kept optimally away from the range of movement of the heel area of the ski boot during walking. It is thus possible to reduce the risk whereby the heel retainer, in the walking setting, impedes the heel area of the ski boot during walking, particularly if snow or ice attaches to the heel area.

A further advantage of the solution according to the invention is that the heel retainer can be moved in a simple way from the first area to the second area of the adjustment path, since, starting from the walking setting, it is movable along the first area of the adjustment path, beyond its holding setting, upward from the first area of the adjustment path into a second area of the adjustment path separate from the first area of the adjustment path and adjoining the first area of the adjustment path, and back again. This makes the operation of the automatic heel unit easier.

If the automatic heel unit moreover permits a safety release in the forward direction, a simple and reliably functioning safety release can be permitted by the heel retainer movable beyond its holding setting upward from the first area of the adjustment path into the second area of the adjustment path. The safety of the skier can thus be enhanced.

In its holding setting, the heel retainer is preferably located in a transition area, particularly preferably in a transition from the first area of the adjustment path to the second area of the adjustment path. This has the advantage that the first area of the adjustment path is separated from the second area of the adjustment path by the holding setting.

However, as an alternative to this, there is also the possibility that the heel retainer, in its holding setting, is not located in the transition or transition area from the first area to the second area of the adjustment path. In its holding setting, the heel retainer can then be located, for example, within the first area, within the second area or within any further area of the adjustment path.

In its walking setting, the heel retainer is preferably located at an end of the first area of the adjustment path. In its walking setting, the heel retainer is preferably also located at the same time at an end of the adjustment path. This has the advantage that the heel retainer is easily movable from its holding setting to its walking setting, since the walking setting is clearly separate from the holding setting of the heel retainer. As an alternative to this, there is also the possibility that the heel retainer, in its walking setting, is located within the first area of the adjustment path.

The first area of the adjustment path advantageously comprises a vertical component. It is immaterial whether the profile of the first area of the adjustment path, during the adjustment of the heel retainer from the walking setting to the holding setting, leads upward or downward or both upward and also downward. Independently of the profile of the first area of the adjustment path, the heel retainer is located farther to the rear in its walking setting than in its holding setting. Moreover, in its walking setting, the heel retainer can also be located farther upward or farther downward than in its holding setting, independently of the profile of the first area of the adjustment path. However, in its walking setting, the heel retainer can also be located at the same height as in its holding setting, independently of the profile of the first area of the adjustment path.

When the first area of the adjustment path comprises a vertical component, it is possible to achieve the advantage whereby a particularly compact configuration of the automatic heel unit is permitted. For example, in the first area of the adjustment path, the heel retainer can be guided around an existing element of the automatic heel unit and thereby positioned in a way that saves space. Moreover, this also allows the heel retainer to be positioned higher or lower in the walking setting than in the holding setting. This has the advantage that the heel retainer, in its walking setting, can be arranged in a way that particularly saves space. This permits a particularly compact configuration of the automatic heel unit in the walking configuration.

As an alternative to this, there is also the possibility that the first area of the adjustment path does not comprise a vertical component. In this case, the first area of the adjustment path is oriented horizontally.

The heel retainer is preferably located farther down in its walking setting than in its holding setting. The position of the heel retainer in its walking setting is independent of the profile of the first area of the adjustment path. It is thus immaterial whether the profile of the first area of the adjustment path, during the adjustment of the heel retainer from the holding setting to the walking setting, leads downward or both upward and also downward. If the heel retainer is located farther down in its walking setting than in its holding setting, this has the advantage that the heel retainer, in its walking setting, can be arranged on the automatic heel unit in a way that particularly saves space. This permits a particularly compact design of the automatic heel unit.

As an alternative to this, there is also the possibility that the heel retainer, in its walking setting, is located at the same height as in its holding setting or farther upward than in its holding setting.

The heel retainer is preferably movable from the second area of the adjustment path, beyond its holding setting, downward from the second area of the adjustment path into the first area of the adjustment path. The heel retainer is therefore moved downward into the first area of the adjustment path directly after the transition from the second area to the first area of the adjustment path. It is immaterial here whether the movement of the heel retainer directly after the transition from the second area to the first area of the adjustment path additionally has or does not have a component lying in a plane parallel to the ski. It is also immaterial whether the heel retainer can already be moved downward in the second area of the adjustment path or can only be moved downward in the first area of the adjustment path. However, starting from the second area of the adjustment path, the heel retainer is preferably movable along the second area of the adjustment path, beyond its holding setting, downward from the second area of the adjustment path substantially rectilinearly into the first area of the adjustment path. This has the advantage that the heel retainer can be very easily moved by the skier from the second area of the adjustment path into the first area of the adjustment path. For example, the skier can easily move the heel retainer from above, by hand or with a ski stick, from the second area of the adjustment path downward into the first area of the adjustment path.

As an alternative to this, there is also the possibility that the heel retainer is movable from the second area of the adjustment path not downwardly but instead in a horizontal direction or upward from the second area of the adjustment path into the first area of the adjustment path.

Preferably, the first area of the adjustment path is substantially linear. Accordingly, the center of gravity of the heel retainer is for the most part moved relative to the heel retainer support when the heel retainer is moved within the first area of the adjustment path relative to the heel retainer support. It is immaterial whether the first area of the adjustment path has one or more limited partial areas that are non-linear. For example, the heel retainer is movable with its center of gravity to a position in the first area of the adjustment path at which the heel retainer is rotatable about its center of gravity before it is movable with its center of gravity from this position farther along the first area of the adjustment path. It is also immaterial whether the linear parts of the first area of the adjustment path are rectilinear or curved or have both rectilinear and also curved portions. A substantially linear first area of the adjustment path has the advantage that the heel retainer can be moved easily and quickly along the first area of the adjustment path.

In a preferred variant thereof, the first area of the adjustment path is linear. This has the advantage that the heel retainer can be moved particularly easily and quickly along the first area of the adjustment path, as a result of which the operation of the automatic heel unit can be additionally simplified.

Preferably, the second area of the adjustment path is substantially linear. This has the advantage that the heel retainer can be moved easily and quickly along the second area. It is immaterial whether the second area of the adjustment path has one or more partial areas that are non-linear. It is also immaterial whether the linear parts of the second area of the adjustment path are rectilinear or curved or have both rectilinear and also curved portions. In a preferred variant thereof, the second area of the adjustment path is linear. This has the advantage that the heel retainer can be moved particularly easily and quickly along the second area of the adjustment path.

If the automatic heel unit additionally permits a safety release and if, in the case of a safety release, the heel retainer, starting from its holding setting, is movable along a linear partial area of the second area of the adjustment path until the heel area of the ski boot held in the automatic heel unit is released from the automatic heel unit, a rapid and therefore efficiently functioning safety release is thus permitted by the linear partial area of the second area of the adjustment path. This enhances the safety for the skier.

If the first area and the second area of the adjustment path are substantially linear, the adjustment path can preferably be continuously differentiated in a transition area from the first area to the second area. Thus, the adjustment path is also linear in this transition area. Moreover, the adjustment path can also be rectilinear or curved in the transition area from the first area to the second area. However, the transition area cannot have a bend. This has the advantage that the heel retainer is movable smoothly and quickly from the first area of the adjustment path into the second area of the adjustment path and back again. This makes the operation of the automatic heel unit more convenient for the skier.

As an alternative to this, there is also the possibility that the adjustment path is not able to be continuously differentiated in the transition area from the first area to the second area and instead has a bend. This is the case, for example, when the first area of the adjustment path adjoins the second area of the adjustment path horizontally or almost horizontally, while the second area of the adjustment path adjoins the first area of the adjustment path in a substantially vertical orientation.

Independently of whether the first area of the adjustment path is substantially linear or not, the first area of the adjustment path preferably extends in a plane that is oriented vertically in the longitudinal direction of the ski. This means that if the heel retainer is pivoted about its center of gravity during a movement along the first area of the adjustment path, this pivoting movement also takes place in this plane oriented vertically in the longitudinal direction of the ski. This has the advantage that the automatic heel unit can have a compact construction.

Independently of whether the second area of the adjustment path is substantially linear or not, the second area of the adjustment path preferably extends in a plane that is oriented vertically in the longitudinal direction of the ski. This means that if the heel retainer is pivoted about its center of gravity during a movement along the second area of the adjustment path, this pivoting movement also takes place in this plane oriented vertically in the longitudinal direction of the ski. This likewise has the advantage that the automatic heel unit can have a compact construction.

Preferably, both the first area of the adjustment path and also the second area of the adjustment path extend in a plane that is oriented vertically in the longitudinal direction of the ski. This means that, if the heel retainer is pivoted about its center of gravity during a movement along the first or second area of the adjustment path, this pivoting movement also takes place in this plane oriented vertically in the longitudinal direction of the ski. This has the advantage that the automatic heel unit can be constructed in a particularly compact design.

As an alternative to this, there is also the possibility that the entire adjustment path or an area of the adjustment path extends in a plane that is at an angle to the plane oriented vertically in the longitudinal direction of the ski.

Preferably, the automatic heel unit comprises an elastic element with which the heel retainer is pretensioned toward its holding setting, at least in a partial area of the second area of the adjustment path adjoining the first area of the adjustment path. This has the advantage that the heel area of the ski boot held by the heel retainer can be pretensioned toward the holding setting of the heel retainer. Moreover, a safety release can be made available in which, in order to release the heel area of the ski boot from the automatic heel unit during a safety release, the heel retainer is designed to be movable, along the partial area of the second area of the adjustment path adjoining the first area of the adjustment path, away from the holding setting counter to the pretensioning generated by the elastic element. Accordingly, the safety of the skier can thus be enhanced.

The elastic element preferably comprises a spring for generating the pretensioning. However, the elastic element can also be designed differently. It is immaterial where the heel retainer is located in its holding setting on the adjustment path. It is also immaterial whether the heel retainer is moreover pretensioned toward its holding position at least in a partial area of the first area of the adjustment path. It is moreover immaterial whether the heel retainer, additionally to being pretensioned toward its holding setting, is pretensioned in another direction in a further partial area of the second area of the adjustment path by the elastic element or by a second elastic element separate from the latter. For example, if the heel retainer has a release setting, the heel retainer can be pretensioned toward this release setting in a further partial area of the second area of the adjustment path. The pretensioning can in this case be generated by the elastic element or by a second elastic element separate from the latter. This has the advantage that the heel retainer remains in the release setting and does not inadvertently move from its release setting to its holding setting.

In a variant thereof, there is also the possibility that the heel retainer is not pretensioned toward its holding setting but instead pretensioned in another direction, at least in the partial area of the second area of the adjustment path adjoining the first area of the adjustment path.

As an alternative to this, it is also possible that the heel retainer does not comprise an elastic element with which the heel retainer is pretensioned at least in the partial area of the second area of the adjustment path adjoining the first area of the adjustment path. In this case, for example, the heel retainer can be adjusted manually to a desired position.

If the heel retainer, in the partial area of the second area of the adjustment path adjoining the first area of the adjustment path, is pretensioned toward its holding setting by an elastic element, then, at each position of the heel retainer in this partial area of the second area of the adjustment path, the force generated by the elastic element is oriented at an acute angle to an orientation of the second area of the adjustment path at the respective position of the heel retainer. Preferably, the adjustment path is linear in the partial area of the second area of the adjustment path adjoining the first area of the adjustment path. In this case, the orientation of the adjustment path at the respective position of the heel retainer in the second area of the adjustment path adjoining the first area of the adjustment path corresponds to a tangent, which is placed on the adjustment path at the respective position of the heel retainer. Thus, at each position of the heel retainer in the partial area of the second area of the adjustment path, the force generated by the elastic element for the purpose of tensioning the heel retainer toward its holding setting is not oriented parallel to the orientation of the adjustment path at this position of the heel retainer but instead always at an acute angle, i.e. at an angle of more than 0° and less than 90° with respect to the orientation of the adjustment path at this position. The angle between the force and the orientation of the adjustment path is the smallest angle between the direction in which the force acts and the orientation of the adjustment path defined by the tangent and thus by a straight line. Independently of this angle, the force generated by the elastic element for the purpose of tensioning the heel retainer toward its holding setting can be transmitted directly or indirectly to the heel retainer. Since the force generated by the elastic element is oriented at an acute angle with respect to the orientation of the second area of the adjustment path at the respective position of the heel retainer, this affords the advantage that the elastic element can be oriented at an acute angle with respect to the partial area of the second area of the adjustment path. Thus, the device which permits the movement of the heel retainer on the adjustment path relative to the heel retainer support can be separated in the best possible way from the elastic element. Therefore, this device can have a more compact and more stable construction. Moreover, if need be, a larger elastic element can thus be used, without the overall automatic heel unit having to be made much bigger and more solid.

Advantageously, at each position of the heel retainer in the partial area of the second area of the adjustment path adjoining the first area of the adjustment path, the force generated by the elastic element for the purpose of tensioning the heel retainer toward its holding setting is oriented at an angle in a range of 20° to 70°, preferably in a range of 40° to 70°, particularly preferably in a range of 50° to 70°, with respect to the orientation of the adjustment path at the respective position of the heel retainer. This has the advantage that the construction of the device permitting the movement of the heel retainer on the adjustment path relative to the heel retainer support can be optimally separated from the construction of the elastic element. Accordingly, if need be, a larger elastic element can thus be used, without the overall automatic heel unit having to be made much bigger and more solid. If the automatic heel unit permits a safety release, it is therefore possible, in the event of an impact on the ski boot, the ski binding or the ski, for a greater energy to be taken up before a safety release is effected, even in the case of an automatic heel unit with a compact construction.

As an alternative to this, there is also the possibility that the force generated by the elastic element is oriented at an obtuse angle, i.e. at an angle of 90° or more, with respect to an orientation of the partial area of the second area of the adjustment path at the respective position of the heel retainer.

The force transmission from the elastic element to the heel retainer preferably takes place indirectly via at least one intermediate element. This has the advantage that the force generated by the elastic element can be transmitted optimally to the heel retainer. The intermediate element is preferably a detent. Such a detent can, for example, be mounted on the heel retainer support so as to be pivotable about an axle, and it can be arranged between the elastic element and the heel retainer. The force generated by the elastic element for the purpose of tensioning the heel retainer toward its holding setting is preferably transmitted from the elastic element to the heel retainer via the detent. However, there is also the possibility of one or more further intermediate elements being arranged between the elastic element and the detent and between the detent and the heel retainer.

In a variant thereof, however, there is also the possibility that none of the at least one intermediate element is a detent.

As an alternative to this, however, there is also the possibility that the force is transmitted from the elastic element to the heel retainer directly, i.e. without an intermediate element.

Preferably, the heel retainer is freely movable along the first area of the adjustment path. This means that the heel retainer is movable along the first area of the adjustment path without pretensioning, i.e. without a force being generated by the elastic element and acting on the heel retainer. The heel retainer is thus movable along the first area of the adjustment path only against an optionally present frictional force. This has the advantage that the automatic heel unit can be produced in a simple construction and cost-effectively. It is immaterial whether the adjustment path is linear or non-linear in its first area, since the heel retainer can be freely movable both in a translation movement and also in a rotation movement. It is also immaterial whether the heel retainer, in the second area, is wholly or partially pretensioned by an elastic element or whether the heel retainer is likewise freely movable in the second area of the adjustment path, i.e. without pretensioning.

If the heel retainer, in its holding setting, is located at a transition from the first area of the adjustment path to the second area of the adjustment path and the automatic heel unit comprises an elastic element with which the heel retainer is pretensioned toward its holding setting, at least in a partial area of the second area of the adjustment path adjoining the first area of the adjustment path, then the heel retainer is preferably movable from its walking setting to its holding setting and back again along the first area of the adjustment path without pretensioning, i.e. without a force being generated by an elastic element and acting on the heel retainer. This has the advantage that the automatic heel unit can be operated particularly easily.

As an alternative to this, there is also the possibility that the heel retainer is not freely movable along the first area of the adjustment path but instead, for example, is pretensioned toward its holding setting or toward its walking setting.

The automatic heel unit advantageously comprises a base element for mounting the automatic heel unit on an upper face of a ski, wherein the heel retainer support is arranged on the base element. It is immaterial whether the heel retainer support is connected to the base element directly or indirectly, i.e. via at least one intermediate element. Moreover, it is immaterial whether the heel retainer support is mounted movably on the base element or is fixedly connected to the base element or produced integrally with the base element. Irrespective of this, the base element has the advantage that the heel retainer support can be mounted easily on the ski.

The heel retainer support is preferably movable relative to the base element. This has the advantage that the position of the heel retainer support is adaptable to different sizes of ski boots.

As an alternative to this, however, there is also the possibility that the automatic heel unit has no such base element.

The heel retainer preferably has a holding-down structure by which the heel area of the ski boot held in the ski binding is maintained in the lowered position in the holding configuration of the automatic heel unit. This has the advantage that the heel retainer can optimally hold the heel area in the lowered position.

In a preferred variant thereof, the holding-down structure is arranged fixedly, i.e. immovably, on the heel retainer. This has the advantage of affording a particularly stable hold of the ski boot held in the holding configuration in the automatic heel unit. As an alternative to this, however, there is also the possibility that the holding-down structure is mounted movably on the heel retainer.

Independently of whether the holding-down structure is arranged fixedly or movably on the heel retainer, the holding-down structure in a preferred variant is designed to engage at the top, in the holding configuration of the automatic heel unit, around the sole of the ski boot in the heel area, so that the heel area of the ski boot held in the ski binding is maintained in the lowered position. In a preferred alternative to this, however, there is also the possibility that the holding-down structure is designed to engage, in the holding configuration of the automatic heel unit, in a recess in the heel area of the sole of the ski boot, so that the heel area of the ski boot held in the ski binding is maintained in the lowered position.

Independently of the design of the holding-down structure, the heel retainer advantageously has a heel-supporting structure for supporting the heel area in a direction horizontally transverse to the ski. This has the advantage that the heel retainer can securely hold the heel area of the ski boot. In this way, the heel area of the ski boot is held securely even in the event of considerable forces and in the event of vibrations. This increases the safety for the skier. It is immaterial here whether the holding-down structure and the heel-supporting structure are separate structures or are formed by one and the same structure.

In a preferred variant thereof, the heel-supporting structure is arranged fixedly, i.e. immovably, on the heel retainer. This has the advantage of achieving a particularly stable hold of the ski boot held in the automatic heel unit in the holding configuration. As an alternative to this, however, there is also the possibility that the heel-supporting structure is mounted movably on the heel retainer.

Independently of whether the heel-supporting structure is arranged fixedly or movably on the heel retainer, the heel-supporting structure is preferably designed such that, in the holding configuration of the automatic heel unit, it engages laterally and slightly forward around the sole of the ski boot in the heel area, so that the heel area of the ski boot held in the ski binding is supported in a direction horizontally transverse to the ski. In a preferred alternative thereof, however, there is also the possibility that the heel-supporting structure is designed to engage, in the holding configuration of the automatic heel unit, in a recess in the heel area of the sole of the ski boot, so that the heel area of the ski boot held in the ski binding is supported in a direction horizontally transverse to the ski.

In a preferred variation thereof, the heel retainer is a jaw. This means that the holding-down structure is designed to engage, in the holding configuration of the automatic heel unit, over the sole of the ski boot in the heel area such that the heel area of the ski boot held in the ski binding is maintained in the lowered position, and that the heel-supporting structure is designed to engage, in the holding configuration of the automatic heel unit, laterally and slightly forward around the sole of the ski boot in the heel area, so that the heel area of the ski boot held in the ski binding is supported in a direction horizontally transverse to the ski. This has the advantage that a very stable hold of the heel area of the ski boot can be achieved in the holding configuration of the automatic heel unit.

In a preferred variant thereof, the holding-down structure and the heel-supporting structure are formed by the same structure. This is preferably in the form of two pins which are arranged alongside each other and which, in the holding setting of the heel retainer, have their free ends pointing forward substantially horizontally. This has the advantage that the heel retainer can be of a light and compact construction. In these aforementioned design variants of the heel retainer, it is immaterial whether the heel retainer is produced in one piece or in several pieces.

As an alternative to the aforementioned variants, however, there is also the possibility that the heel retainer is configured differently.

The automatic heel unit preferably has a release configuration in which the heel retainer is located in a release setting and the heel area of the ski boot is freed from the heel retainer. In the release configuration, the skier can step out of the automatic heel unit. The release configuration also preferably serves to position the heel area of the ski boot in the automatic heel unit, so as to be able to step into the automatic heel unit. The release configuration, in which the heel retainer is located in its release setting and the heel area of the ski boot is freed from the heel retainer, has the advantage of making it easier to step into the automatic heel unit and step out of the automatic heel unit with the heel area of the ski boot. This enhances the comfort of the skier.

In a variant thereof, the automatic heel unit can moreover have a step-in configuration. The step-in configuration can correspond to the release configuration or can be a separate configuration. It is immaterial here whether the step-in configuration serves only for stepping into the automatic heel unit with the heel area of the ski boot or whether the step-in configuration also permits stepping out of the automatic heel unit. Analogously thereto, it is immaterial whether the release configuration permits only stepping out of the automatic heel unit or permits both stepping out of and also stepping into the automatic heel unit. Moreover, it is immaterial in which area of the adjustment path the heel retainer is located in the step-in configuration. If the automatic heel unit has a step-in configuration that is different than the release configuration, the heel retainer is located, in the step-in configuration of the automatic heel unit, preferably in a step-in setting. Advantageously, the step-in setting of the heel retainer serves for stepping in, and the release setting of the heel retainer serves for stepping out. This has the advantage that the step-in setting of the heel retainer can be optimized for the stepping-in procedure, and the release setting of the heel retainer can be optimized for the stepping-out procedure. This permits simple stepping in and out and enhances the comfort of the skier.

As an alternative to this, however, there is also the possibility that the automatic heel unit has no release configuration and no step-in configuration. In this case, stepping into the automatic heel unit with the heel area of the ski boot and stepping out can take place in any setting of the heel retainer.

If the automatic heel unit has a release configuration in which the heel retainer is located in its release setting, the heel retainer is preferably movable from its holding setting to its release setting and back again along the second area of the adjustment path. The second area of the adjustment path can be linear or can have both linear parts and also non-linear parts. Independently of this, the one or more linear parts of the second area of the adjustment path can be rectilinear or curved. Moreover, the one or more linear parts of the second area can have both rectilinear and also curved portions. If the automatic heel unit has an elastic element with which the heel retainer is pretensioned toward its holding setting in a partial area of the second area of the adjustment path adjoining the first area of the adjustment path, the second area of the adjustment path can also have one or more further partial areas in which the heel retainer is not pretensioned or is pretensioned toward another setting, for example its release setting. Independently of this, the pretensioning of the heel retainer toward its holding setting, in the partial area of the second area of the adjustment path adjoining the first area of the adjustment path, has the advantage that a reliably functioning safety release can be achieved. Independently of the pretensioning of the heel retainer, a heel retainer that is movable from its holding setting to its release setting and back again along the second area of the adjustment path has the advantage that the heel retainer can be easily moved from its holding setting to its release setting and back again. Moreover, the release setting of the heel retainer is in this way optimally separated from the walking setting of the heel retainer. This permits simple adjustment of the automatic heel unit between the walking configuration, the holding configuration and the release configuration. Accordingly, this permits simple operation of the automatic heel unit and minimizes the risk of incorrect manipulation.

As an alternative to this, however, there is also the possibility that the heel retainer is not movable to its release setting and back again along the second area of the adjustment path.

If the automatic heel unit has a release configuration and the heel retainer is movable from its holding setting to its release setting and back again along the second area of the adjustment path, the release setting is preferably located in an end area of the second area of the adjustment path spaced apart from the holding setting. Preferably, the heel retainer in its release setting is then preferably located at a distance from the holding setting of the heel retainer. This has the advantage that the release setting is clearly separate from the holding setting. This facilitates the operation and use of the automatic heel unit, since the danger of an incorrect setting of the heel retainer is reduced.

As an alternative to this, however, there is also the possibility that the release setting of the heel retainer is not located in a spaced-apart end area of the second area of the adjustment path. In this case, for example, the release setting can be located near the holding setting of the heel retainer within the second area of the adjustment path.

Advantageously, the automatic heel unit comprises a heel retainer guide, by which the heel retainer is mounted on the heel retainer support so as to be movable, along the first area of the adjustment path relative to the heel retainer support, from its holding setting to its walking setting and back again. This has the advantage that the heel retainer can be mounted movably in a stable manner on the heel retainer support. In this way, the automatic heel unit can easily have a stable construction.

As an alternative to this, the automatic heel unit can also comprise no such heel retainer guide. Depending on the design of the automatic heel unit, this may have the advantage that the automatic heel unit can be made lighter.

If the automatic heel unit comprises a heel retainer guide, the heel retainer is advantageously mounted so as to be rotatable and also movable by the heel retainer guide along the first area of the adjustment path relative to the heel retainer support from its holding setting to its walking setting and back again. It is immaterial here whether the adjustment path is only linear in its first area, and therefore the center of gravity of the heel retainer is also moved during a rotation of the heel retainer, or whether the adjustment path has, in its first area, a non-linear portion in which the center of gravity of the heel retainer is not moved during a rotation of the heel retainer. Independently thereof, this has the advantage that the heel retainer, in its holding setting and in its walking setting, can be positioned and oriented optimally with respect to the heel retainer support.

As an alternative to this, however, there is also the possibility that the heel retainer is mounted so as to be movable by the heel retainer guide, without rotation, along the first area of the adjustment path relative to the heel retainer support from its holding setting to its walking setting and back again.

If the automatic heel unit comprises a heel retainer guide, the heel retainer guide is preferably a positive control of the heel retainer, by which the heel retainer is mounted on the heel retainer support so as to be movable along the first area of the adjustment path relative to the heel retainer support from its holding setting to its walking setting and back again. This has the advantage that the heel retainer can be mounted so as to be movable in a stable manner along the first area of the adjustment path relative to the heel retainer support. The safety of the skier can thus be increased.

As an alternative to this, however, there is also the possibility that the heel retainer guide is not a positive control of the heel retainer by which the heel retainer is mounted on the heel retainer support so as to be movable along the first area of the adjustment path relative to the heel retainer support from its holding setting to its walking setting and back again.

If the automatic heel unit comprises a heel retainer guide and has a release configuration in which the heel retainer is located in a release setting and the heel area of the ski boot is freed from the heel retainer, and the heel retainer is movable from its holding setting to its release setting and back again along the second area of the adjustment path, then the heel retainer is preferably likewise mounted on the heel retainer support so as to be movable by the heel retainer guide along the second area of the adjustment path relative to the heel retainer support from its holding setting to its release setting and back again. This also has the advantage that guiding of the heel retainer along the second area of the adjustment path can be achieved in a simple manner.

Preferably, the heel retainer is mounted so as to be rotatable and also movable by the heel retainer guide along the second adjustment path relative to the heel retainer support from its holding setting to its release setting and back again. It is immaterial here whether the adjustment path is only linear in its second area, and therefore the center of gravity of the heel retainer is also moved during a rotation of the heel retainer, or whether the adjustment path has, in its second area, a non-linear portion in which the center of gravity of the heel retainer is not moved during a rotation of the heel retainer. Independently thereof, this has the advantage that the heel retainer, both in its holding setting and in its release setting, can be positioned and oriented particularly advantageously. This makes it easier to step into the automatic heel unit and to step out of the automatic heel unit.

As an alternative to this, however, there is also the possibility that the heel retainer is mounted so as to be movable by the heel retainer guide, without rotation, along the second area of the adjustment path relative to the heel retainer support from its holding setting to its release setting and back again.

If the automatic heel unit comprises a heel retainer guide, by which the heel retainer is mounted so as to be movable along the second adjustment path relative to the heel retainer support from its holding setting to its release setting and back again, then the heel retainer guide is preferably a positive control of the heel retainer, by which the heel retainer is mounted on the heel retainer support so as to be movable along the second area of the adjustment path relative to the heel retainer support from its holding setting to its release setting and back again. This has the advantage that the heel retainer can be mounted so as to be movable in a stable manner along the second area of the adjustment path relative to the heel retainer support. If the automatic heel unit additionally has an elastic element with which the heel retainer is pretensioned toward its holding setting, at least in a partial area of the second area of the adjustment path adjoining the first area of the adjustment path, the positive control has the effect that the force generated by the elastic element can act on the heel retainer directly or indirectly also at an angle of more than 0°, for example at an acute angle to the orientation of the adjustment path at the respective position of the heel retainer, since the heel retainer is held securely on the second area of the adjustment path by the positive control. This has the advantage that the construction of the automatic heel unit can be simplified. In particular, a safety release optionally permitted by the automatic heel unit can in this way also be optimized.

As an alternative to this, however, there is also the possibility that the heel retainer guide is not a positive control of the heel retainer by which the heel retainer is mounted on the heel retainer support so as to be movable along the second area of the adjustment path relative to the heel retainer support from its holding setting to its release setting and back again.

If the automatic heel unit has a heel retainer guide, the heel retainer support preferably comprises a groove, which forms a constituent part of the heel retainer guide. The shape of the groove is immaterial here. For example, the groove can have the shape of an oblong hole or it can also be arc-shaped. Moreover, it is immaterial whether the groove forms a continuous opening through the heel retainer support or whether the groove is only formed as a depression in the surface of the heel retainer support. The groove of the heel retainer guide has the advantage that the heel retainer can be easily mounted on the heel retainer support.

The heel retainer guide preferably also comprises a pin arranged on the heel retainer. The pin can have any desired shape in cross section. For example, it can have a circular cross section or also a square cross section. The heel retainer can also comprise several pins. It is immaterial here whether the pins are configured as independent elements or whether the pins are connected to each other. For example, two pins can be connected to form an axle.

In such a variant, the pin of the heel retainer, in a part of the adjustment path, is advantageously guided in the groove of the heel retainer support. This part can be located in the first area or in the second area of the adjustment path. However, this part of the adjustment path can equally be located partially in the first area of the adjustment path and partially in the second area of the adjustment path. Irrespective of where the part is located, a positive guide can easily be formed by the pin guided in the groove. Moreover, the heel retainer can be guided, with its pins in the groove of the heel retainer support, in such a way that the heel retainer, during a movement along the corresponding part of the adjustment path, executes a translation movement or a rotation movement or both a translation movement and a rotation movement.

The groove of the heel retainer support and the pin of the heel retainer afford the advantage that the heel retainer is mounted securely and easily on the heel retainer support. This permits a cost-effective design of the heel retainer guide. It is immaterial here whether the heel retainer guide comprises further elements for mounting the heel retainer on the heel retainer support.

As an alternative to this, there is also the possibility that the heel retainer guide comprises no groove and no pin. In this case, for example, the heel retainer guide can have a rail or a lever arrangement for guiding the heel retainer on the heel retainer support.

The automatic heel unit preferably comprises an actuation lever which, when actuated, allows the automatic heel unit to be adjusted from the holding configuration to the walking configuration and back again. The heel retainer is thereby movable by the actuation lever from its holding setting to its walking setting and back again. This has the advantage that the automatic heel unit can be easily adjusted manually from the holding configuration to the walking configuration and back again.

If the automatic heel unit moreover has a release configuration in which the heel retainer is located in a release setting and the heel area of the ski boot is freed from the heel retainer and the heel retainer is movable from its holding setting to its release setting and back again along the second area of the adjustment path, then the automatic heel unit is preferably adjustable from the holding configuration to the release configuration by actuation of the actuation lever. This has the advantage that the automatic heel unit can be easily adjusted manually from the holding configuration to the release configuration and back again.

As an alternative to this, however, there is also the possibility that the automatic heel unit comprises no such actuation lever.

If the automatic heel unit comprises an actuation lever which, when actuated, allows the automatic heel unit to be adjusted from the holding configuration to the walking configuration and back again, then the automatic heel unit preferably comprises an actuation lever guide for transmitting a movement of the actuation lever to the heel retainer. This has the advantage that a movement can be easily and safely transmitted from the manually activated actuation lever to the heel retainer.

The actuation lever guide preferably comprises several elements. These elements do not have to be arranged directly on the actuation lever. For example, the actuation lever, but also the heel retainer and the heel retainer support, can have elements of the actuation lever guide. Preferably, the actuation lever guide comprises a cam arranged on the actuation lever, and a recess arranged on the heel retainer, wherein the cam of the actuation lever is guided in the recess of the heel retainer. Independently thereof, the actuation lever guide allows a movement of the actuation lever to be transmitted to the heel retainer such that the heel retainer is movable by the actuation lever, along the first area of the adjustment path relative to the heel retainer support, from the holding setting of the heel retainer to the walking setting of the heel retainer and back again. This has the advantage that, by manual actuation of the actuation lever, the heel retainer can be moved easily and quickly between its walking setting and its holding setting.

If the automatic heel unit moreover has a release configuration in which the heel retainer is located in a release setting and the heel area of the ski boot is freed from the heel retainer and the heel retainer is movable from its holding setting to its release setting and back again along the second area of the adjustment path, then the actuation lever guide advantageously also serves to transmit a movement of the actuation lever to the heel retainer within the second area of the adjustment path. This has the advantage that, by manual actuation of the actuation lever, the heel retainer can be moved easily and quickly between its holding setting and its release setting.

Independently of whether the automatic heel unit has a release configuration and whether the actuation lever guide also serves or not to transmit a movement of the actuation lever to the heel retainer within the second area of the adjustment path, if the actuation lever guide comprises a cam arranged on the actuation lever and a recess arranged on the heel retainer, the recess on the heel retainer is preferably designed as a cam disk, and the actuation lever is preferably mounted rotatably on the heel retainer support. Thus, by virtue of the shape of the cam of the actuation lever and the shape of the cam disk of the heel retainer, a rotation movement of the actuation lever can be converted to a movement of the heel retainer with a complex movement profile. This has the advantage that a simple rotation movement of the actuation lever can be converted to a movement of the heel retainer with a complex movement profile, during which the heel retainer can execute both translation movements and also rotation movements. In this way, the movement profile of the heel retainer can be optimally adapted to the requirements placed on the automatic heel unit.

As an alternative to this, however, there is also the possibility that the actuation lever guide is differently configured. Moreover, there is also the possibility that the automatic heel unit has no actuation lever guide at all.

Advantageously, the automatic heel unit permits a safety release. This has the advantage of increasing the safety of the skier.

If the automatic heel unit has a release configuration, the automatic heel unit is advantageously adjustable from the holding configuration to the release configuration in the case of a safety release. The automatic heel unit is preferably located in this release configuration after a safety release. This has the advantage that the automatic heel unit with the release configuration can be specifically adapted to the release procedure, and removal of the ski boot from the automatic heel unit is thus made easier.

If the automatic heel unit has no release configuration, then, in the case of a safety release for example, the automatic heel unit is adjustable from its holding configuration to a configuration in which the heel area of the ski boot is freed. Thereafter, the automatic heel unit can, for example, be transferred back to the holding configuration or to the walking setting. This has the advantage that the automatic heel unit can be constructed easily and cost-effectively.

If the automatic heel unit permits a safety release, then the automatic heel unit advantageously permits a safety release in the forward direction. In the case of the safety release in the forward direction, the heel area of the ski boot can be removed upward from the automatic heel unit. This affords the advantage that, in the case of a safety release as a result of the skier falling, the heel area of the ski boot can be removed in a controlled manner from the automatic heel unit in the forward direction.

In another preferred variant, the automatic heel unit permits a lateral safety release. In the case of the lateral safety release, the heel area can be removed from the automatic heel unit laterally and horizontally in a direction transverse to the ski. This affords the advantage that, in the case of a lateral safety release as a result of the skier falling or twisting sideways, the heel area of the ski boot can be removed horizontally from the automatic heel unit in a controlled manner in a direction transverse to the ski.

As a variant thereof, there is also the possibility that the automatic heel unit permits both a safety release in the forward direction and also a lateral safety release. This has the advantage that the safety of the skier can be further enhanced.

As an alternative to these variants, however, there is also the possibility that the automatic heel unit does not permit a safety release.

Advantageously, the automatic heel unit comprises a ski brake which is adjustable between a braking setting and a travel setting and which is movable in translation relative to the heel retainer support. When the automatic heel unit is mounted on a ski, the ski brake performs a braking function in its braking setting, whereas it performs no such braking function in its travel position. A ski brake of this kind can also be used, independently of the above-described automatic heel unit, in an automatic heel unit which comprises a heel retainer support and a heel retainer for holding a ski boot in a heel area of the ski boot. It can in this case have the features described below, also independently of the above-described automatic heel unit.

The ski brake preferably comprises two arms with free ends and a bearing element, wherein the two arms are mounted on the bearing element so as to be rotatable about an axle relative to the bearing element, in order to adjust the ski brake between its braking setting and its travel setting. The axle is preferably oriented horizontally, particularly preferably horizontally in the transverse direction of the ski. The axle has the effect that, in a automatic heel unit mounted with the ski brake on a ski, the free ends of the arms can be pivoted downward past the sliding surface of the ski in the braking setting, in order to perform a braking function, and that the free ends of the arms can be moved upward past the sliding surface of the ski in the travel position, in order to perform no such braking function. Independently of the embodiment of the braking setting and of the travel setting, the wording to the effect that the ski brake is movable in translation with respect to the heel retainer support in this case means that the axle is movable in translation relative to the heel retainer support. It is immaterial here whether the bearing element is likewise movable or not in translation relative to the heel retainer support. It is likewise immaterial whether, in such a translation movement, the ski brake is located in its braking setting or its travel setting or is adjusted between its braking setting and its travel setting.

If the automatic heel unit, like the automatic heel unit described above, has a holding configuration in which the heel retainer is located in a holding setting and the heel retainer can interact with the heel area of the ski boot held in the ski binding in such a way that the heel area of the ski boot is maintained in a lowered position, and the automatic heel unit has a walking configuration in which the heel retainer is located in a walking setting and the heel area of the ski boot held in the ski binding is freed from the heel retainer and can be lowered toward the ski without being locked in the lowered position by the heel retainer, then the ski brake is preferably located, in the walking configuration of the automatic heel unit, in a walking position relative to the heel retainer support and, in the holding configuration of the automatic heel unit, in a downhill position relative to the heel retainer support. The ski brake is preferably adjustable from its downhill position to its walking position and back again by adjustment of the automatic heel unit from its holding configuration to its walking configuration and back again. Independently of this adjustability, the ski brake, in its downhill position, is preferably adjustable from its braking setting to its travel setting and back again. Moreover, the ski brake is preferably adjustable from its braking setting to its travel setting in its walking position.

In a preferred embodiment, the automatic heel unit comprises a brake holder, with which the ski brake in its walking position can be locked in the travel setting. In a preferred variant thereof, the ski brake, in the walking configuration of the automatic heel unit in which it is located in its walking position, is adjustable from its braking setting to its travel setting and can be locked in its travel setting by the brake holder. However, if the ski brake, in its walking position, is not adjustable from its walking setting to its travel setting, then the ski brake can be brought to its travel setting, preferably by adjustment from its downhill position to its walking position, and can be locked in its travel setting. It is immaterial how the ski brake is adjustable from its downhill position to its walking position. Moreover, it is immaterial whether the ski brake, in its downhill position, before an adjustment from its downhill position to its walking position, is located in its braking setting or in its travel setting.

If the automatic heel unit comprises a base element for mounting the automatic heel unit on an upper face of a ski, the ski brake is preferably movable relative to the base element. The ski brake is preferably movable in translation relative to the base element. Both have the advantage that the position of the ski brake relative to the base element can be modified and, consequently, the ski brake can be differently positioned according to the configuration of the automatic heel unit. Preferably, the ski brake is mounted movably on the base element. This permits a compact construction of the automatic heel unit. If the ski brake has two arms and a bearing element, wherein the two arms are mounted on the bearing element so as to be rotatable relative to the bearing element about an axle, then the bearing element is preferably mounted movably on the base element in order to achieve this advantage.

As an alternative to this, however, there is also the possibility that the ski brake is not mounted movably on the base element or is mounted movably in a different way on the base element, or that the ski brake is not movable relative to the base element or is arranged fixedly on the base element.

If the automatic heel unit has a ski brake and, moreover, the heel retainer, as in the automatic heel unit described above, is mounted on the heel retainer support so as to be movable along an adjustment path relative to the heel retainer support, then the ski brake is preferably coupled to the heel retainer of the automatic heel unit, as a result of which a movement of the heel retainer along the adjustment path relative to the heel retainer support can be converted to a movement of the ski brake relative to the heel retainer support. It is immaterial here whether the coupling of the ski brake to the heel retainer is effected directly or indirectly via at least one intermediate element. Moreover, "coupled" does not mean that the movement of the heel retainer has to be transmitted unchanged to the ski brake and vice versa. For example, the movement of the heel retainer can be transmitted to the ski brake with a step-up or with a step-down ratio. There is also the possibility that a movement profile of the ski brake deviates from a movement profile of the heel retainer. It is thus immaterial whether the ski brake is coupled to the movement of the heel retainer in the entire adjustment path of the heel retainer, or whether the ski brake is coupled to the heel retainer only in a part of the adjustment path of the heel retainer. A ski brake which is coupled in this way to the heel retainer of the automatic heel unit has the advantage that the position of the ski brake is adaptable to the position of the heel retainer and vice versa. The operation of the automatic heel unit can thus be made easier.

The ski brake is advantageously coupled to the heel retainer of the automatic heel unit, as a result of which a movement of the heel retainer along the first area of the adjustment path relative to the heel retainer support can be converted to a movement of the ski brake relative to the heel retainer support. This has the advantage that the ski brake can be positioned differently in the walking setting of the heel retainer than in the holding setting of the heel retainer. If the ski brake, in the walking configuration of the automatic heel unit, is located in a walking position relative to the heel retainer support and, in the holding configuration of the automatic heel unit, is located in a downhill position relative to the heel retainer support, then the ski brake is adjustable from its walking position to its downhill position by this coupling preferably by a movement of the heel retainer along the first area of the adjustment path from its walking setting to its holding setting, and the ski brake is adjustable from its downhill position to its walking position by a movement of the heel retainer along the first area of the adjustment path from its holding setting to its walking setting.

As an alternative to this, there is also the possibility that the ski brake is not coupled to the heel retainer and the ski brake is movable independently of the heel retainer.

If the automatic heel unit has a ski brake, the ski brake advantageously comprises an actuation element for adjusting the ski brake from the braking setting to the travel setting. This has the advantage that the ski brake can be operated in a simple way. Moreover, the ski brake preferably has an elastic element for pretensioning the ski brake toward its braking setting. This has the advantage that, if necessary, the ski brake can be designed to be automatically adjustable to the braking setting. If the ski brake moreover has two arms, then the elastic element is advantageously formed by the two arms. For example, the two arms can be formed by the free ends of a wire bracket or a rod. For example, the bracket can be mounted on the actuation element, and the two arms can be pretensioned away from each other, in order to pretension the ski brake toward the braking setting via a suitably designed bearing of the arms. This has the advantage that the ski brake can have a compact construction. Moreover, this has the advantage that an automatic heel unit can be constructed with the ski brake in such a way that, in the holding configuration of the automatic heel unit in which the ski brake is located in the holding position, the ski brake can be supported with the actuation element against the sole of the ski boot held in the automatic heel unit, so as to hold the ski brake in the travel setting, and that the ski brake can be brought to the braking setting, by the pretensioning of the elastic element, as soon as the ski boot is removed from the automatic heel unit, and therefore the actuation element is freed from the sole of the ski boot. Moreover, an automatic heel unit can thus be constructed with the ski brake in such a way that, in the holding configuration and optionally in the walking configuration of the automatic heel unit, the ski brake is adjustable from the braking setting to the travel setting by actuation of the actuation element with the sole of the ski boot.

As an alternative to this, there is also the possibility that the ski brake comprises no actuation element and no elastic element.

As an alternative to the aforementioned variants of the ski brake and to an automatic heel unit with ski brake, there is also the possibility that the automatic heel unit does not comprise a ski brake.

Further advantageous embodiments and combinations of features of the invention are derived from the following detailed description and from the entirety of the patent claims.

BRIEF DESCRIPTION OF THE DRAWINGS

In the drawings used to explain the illustrative embodiment.

In principle, identical parts are provided with the same reference signs in the figures.

Ways of Implementing the Invention

Figure 1:
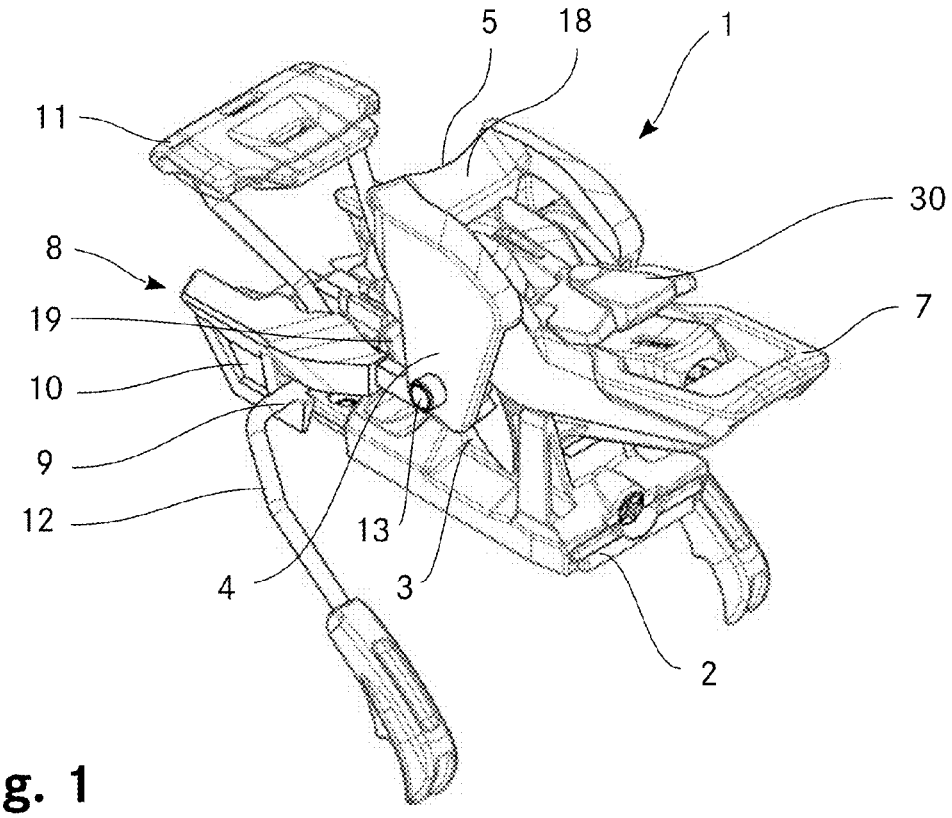
FIG. 1 shows an oblique view of an automatic heel unit according to the invention, in a release configuration in which a heel retainer is located in a release setting and a ski brake is located in a braking setting.

FIG. 1 shows an oblique view of an automatic heel unit 1 according to the invention, in a release configuration. A line that runs horizontally in the longitudinal direction from the front to the rear through the automatic heel unit 1 runs from top left to bottom right in FIG. 1. This line runs parallel to the longitudinal direction of a ski (not shown here) on which the automatic heel unit 1 can be mounted. Here, top left in the figure corresponds to the front of the automatic heel unit 1. Top and bottom in the figure furthermore also correspond to the top and the bottom in the automatic heel unit 1.

The automatic heel unit 1 belongs to a ski binding which, besides the automatic heel unit 1, also comprises an automatic front unit (not shown here) and in which a ski boot can be held. Here, the ski boot can be held both with its toe area in the automatic front unit and also by way of its heel area in the automatic heel unit 1, or else, depending on the construction of the automatic front unit, only by way of its toe area in the automatic front unit, so as to be pivotable about an axle oriented horizontally in the transverse direction of the ski.

The automatic heel unit 1 comprises a base plate 2 which serves as a base element for fitting the automatic heel unit 1 to an upper surface of a ski. Furthermore, the automatic heel unit 1 comprises a heel retainer support 3, a heel retainer 4 for retaining the heel area of the ski boot, an actuation lever 7, a climbing aid lever 30, and a ski brake 8 with a bearing element 10, an actuation element 11 and two arms 12. The arms 12 of the ski brake 8 are mounted on the bearing element 10 in such a way as to be rotatable about an axle 9 relative to the bearing element 10. Moreover, the ski brake 8 with the bearing element 10 is mounted on the base plate 2 so as to be displaceable relative to the base plate 2 and thus movable in translation relative to the heel retainer support 3, such that the axle 9 about which the two arms 12 of the ski brake 8 are mounted rotatably on the bearing element 10 is movable in translation relative to the heel retainer support 3. Moreover, the ski brake 8 is adjustable from a travel setting to a braking setting and back again, by means of the arms 12 being pivoted about the axle 9. In the braking setting, the free ends of the arms extend downward past a sliding surface of the ski, whereas, in the travel setting, they are located above the sliding surface of the ski.

The heel retainer support 3 is likewise mounted on the base plate 2 in such a way as to be displaceable in the longitudinal direction of the ski. Seen in the longitudinal direction of the ski, it can be positioned in different positions on the base plate 2 in order to adapt the automatic heel unit 1 to different sizes of ski boots. Moreover, it is pretensioned in the forward direction by a spring (not visible here) and can be moved slightly rearward in relation to the base plate 2 counter to this pretensioning. When the automatic heel unit 1 forms a ski binding together with an automatic front unit and is mounted on a ski, the automatic heel unit 1 can thus compensate for changes of distance that occur between the automatic front unit and the automatic heel unit 1 when the ski bends.

The heel retainer 4 is mounted on the heel retainer support 3 so as to be movable relative to the heel retainer support 3 along an adjustment path. The heel retainer 4 has two side walls and, in its front area, has a connection web 18 that connects the side walls. Moreover, a horizontally oriented axle 13 in a lower area of the side walls of the heel retainer 4 is connected immovably to both side walls.

Besides the release configuration, the automatic heel unit 1 also has a holding configuration. In this holding configuration, the actuation lever 7 is located in a holding position. Moreover, in the holding configuration of the automatic heel unit 1, the heel retainer 4 is located in a holding setting. In the holding setting, the heel retainer 4 can interact with the heel area of a ski boot (not shown here) held in the ski binding in a lowered position, such that the heel area of the ski boot is maintained in a lowered position. For this purpose, the heel retainer 4 comprises the connection web 18, which forms a holding-down structure 5, which is able to hold the heel area of the ski boot down by engaging from behind and over the sole of the ski boot held in the automatic heel unit 1, in the heel area thereof. Besides the holding-down structure 5, the heel retainer 4 comprises, in its front area underneath the connection web 18, a heel-supporting structure 6 which is able to support the heel area of the ski boot in a direction that is horizontally transverse to the ski, by being able to engage in corresponding recesses in the heel area of the ski boot. However, in a variant thereof, the heel-supporting structure 6 can also be omitted or differently configured and, for example, can engage around the sides of the sole of the ski boot, in the heel area of the ski boot, and extend slightly forward.

Moreover, the automatic heel unit 1 has a walking configuration. In this walking configuration, the actuation lever 7 is located in a first or second climbing position. Moreover, the heel retainer 4 is located in a walking setting, which differs from the holding setting. In the walking setting of the heel retainer 4, the heel area of the ski boot held in the ski binding is freed from the heel retainer 4 and can be lowered toward the ski, without being locked by the heel retainer 4 in the lowered position. The heel retainer 4 is movable from its walking setting to its holding setting and back again along a first area of the adjustment path. Here, the heel retainer 4, in its walking setting, is located farther rearward than in its holding setting. The first area of the adjustment path moreover comprises a vertical component, and the heel retainer 4, in its walking setting, is also located farther down than in its holding setting. Moreover, in its walking setting, the heel retainer 4 is located at an end of the first area of the adjustment path spaced apart from the holding setting of the heel retainer, which end at the same time forms a first end of the adjustment path. By a movement of the actuation lever 7 from its holding position to its climbing position and back again, the automatic heel unit 1 can be adjusted from its holding configuration to its walking configuration and back again. Moreover, the heel retainer 4 can in this way be moved from its holding setting to its walking setting and back again relative to the heel retainer support 3 along the first area of the adjustment path. The actuation lever 7 is moreover adjustable to a second climbing position, in which it serves as a climbing aid. The movement profile of the heel retainer 4 along this first area of the adjustment path is described in detail farther below.

As has already been mentioned in connection with FIG. 1, the automatic heel unit 1 has a release configuration. In this release configuration, the actuation lever 7 is located in a release position. Moreover, the heel retainer 4 is located in a release setting, which differs from the holding setting and from the walking setting. In the release setting of the heel retainer 4, the heel area of the ski boot is freed from the heel retainer 4. By the movement of the actuation lever 7 from the holding position to the release position and back again, the automatic heel unit 1 can be adjusted from the holding configuration to the release configuration and back again. Through the movement of the actuation lever 7, the heel retainer 4 is moved from its holding setting to its release setting and back again relative to the heel retainer support 3 along a second area of the adjustment path. In the release setting, the heel retainer 4 is located at an end of the second area of the adjustment path spaced apart from the holding setting, which end at the same time forms a second end of the adjustment path. By contrast, in its holding setting, the heel retainer 4 is located at a transition from the first area of the adjustment path to the second area of the adjustment path. When the heel retainer 4, starting from its walking setting, is moved along the first area of the adjustment path beyond its holding setting into the second area of the adjustment path, the heel retainer 4 is moved upward into the second area of the adjustment path directly after the transition.

Besides the fact that the automatic heel unit 1 can be adjusted from the release configuration to the holding configuration by a movement of the actuation lever, the automatic heel unit 1 can also be adjusted from its release configuration to its holding configuration by pressing the front area of the heel retainer 4 down with the heel area of the ski boot. Moreover, the automatic heel unit 1 can also be adjusted from its holding configuration to its release configuration by pressing the heel retainer 4 up with the heel area of the ski boot held in the automatic heel unit 1, for example in the case of a safety release.

As has already been mentioned, the holding-down structure 5 of the heel retainer 4 is formed by the connection web 18 of the heel retainer 4. The holding-down structure 5 in this case has the form of a forwardly protruding segment of a circle. Moreover, the heel-supporting structure 6 is formed separately from the holding-down structure 5 and is located below the latter. The heel-supporting structure 6 comprises two forwardly protruding overhangs which are elongate when seen in the vertical direction. Moreover, a forwardly protruding tread spur 19 is located at a lower end of these overhangs. When stepping into the automatic heel unit 1, this tread spur 19 can serve as a vertical stop, so as to be able to position the ski boot more easily in the automatic heel unit 1. Moreover, the tread spur 19 can be pressed downward by the ski boot in order to adjust the automatic heel unit 1 from the release configuration to the holding configuration.

As has already been mentioned, the automatic heel unit 1 has a ski brake 8 in which the arms 12 are mounted on the bearing element 10 so as to be rotatable about the axle 9 relative to the bearing element 10. The two arms 12 are formed by the free ends of a bracket. This bracket cannot be clearly seen in the figures because the connection piece of the bracket, by which the two arms 12 are connected to each other, is arranged in the actuation element 11, while the two free ends of the arms 12 point away from the actuation element 11. The two arms 12 of the bracket are mounted on the bearing element 10 in a mutually clamped state such that they are pretensioned. This pretensioning of the arms 12 is converted, by a suitable shaping of the bearing element 10, into a pretensioning of the ski brake 8 from the travel setting to the braking setting. For this purpose, the bearing element 10 allows the arms 12 of the ski brake 8 to be moved slightly farther apart from each other in the braking setting than in the downhill setting. Therefore, the bracket is slightly less pretensioned in the braking setting than in the downhill setting and accordingly has a tendency to adjust the ski brake 8 to relax from the downhill setting to the braking setting.

In the travel setting of the ski brake 8, the two arms 12 of the ski brake 8 are oriented substantially parallel to the ski and their free ends point rearward. In this way, in the travel setting, the two arms 12 do not extend downward past a sliding surface of the ski. Thus, in the travel setting, the arms 12 do not prevent the ski from sliding freely on the ground. At the same time, in the travel setting of the ski brake 8, the front ends of the arms 12, which are connected to each other by the bracket, are pivoted downward with the actuation element 11 toward the ski to a height of the bearing element 10. By contrast, in the braking setting of the ski brake 8, the arms 12, as has already been mentioned, are pivoted downward about the axle 9, such that the free ends of the arms 12 point obliquely rearward and downward and reach beyond the sliding surface of the ski. Thus, in the braking setting, the arms 12 prevent the ski from sliding freely on the ground. At the same time, in the braking setting of the ski brake 8, the front ends of the arms 12 are pivoted, together with the actuation element 11, upward and away from the bearing element 10 and therefore from the ski. The ski brake 8 can also be maintained in its travel setting since the actuation element 11 is prevented from moving upward away from the ski. This can be done, for example in the holding configuration of the automatic heel unit 1, by a ski boot held in the automatic heel unit 1.

The bearing element 10 of the ski brake 8 is mounted on the base plate 2 so as to be displaceable in the longitudinal direction of the ski. The bearing element 10 can in this case be displaced relative to the base plate 2 independently of the heel retainer support 3. Accordingly, the bearing element 10, together with the axle 9, is movable in translation relative to the heel retainer support 3. Moreover, the ski brake 8 is coupled to the heel retainer 4, as a result of which the ski brake 8 can be moved by a movement of the heel retainer 4. When the heel retainer 4 is located in its holding setting, in its release setting or within the second area of the adjustment path, the ski brake 8 is located in a downhill position relative to the heel retainer support 3. In this downhill position, the ski brake 8 is adjustable from the travel setting to the braking setting and back again. By contrast, when the heel retainer 4 is located in its walking setting, the ski brake 8 is located in a walking position relative to the heel retainer support 3. In this walking position, the ski brake 8 is farther rearward relative to the base plate 2 than in the downhill position. Moreover, it is located closer to the heel retainer support 3 than in the downhill position. Moreover, in the walking position, the ski brake 8 can be moved from the braking setting to the travel setting. However, in the walking position, it hooks into a brake holder, arranged on the base plate 2, when it is moved from the braking setting to the travel setting. In this way, in the walking position, it is locked in the travel setting and, despite pretensioning to the travel setting, no longer pivots back to the travel setting.

Figure 2:
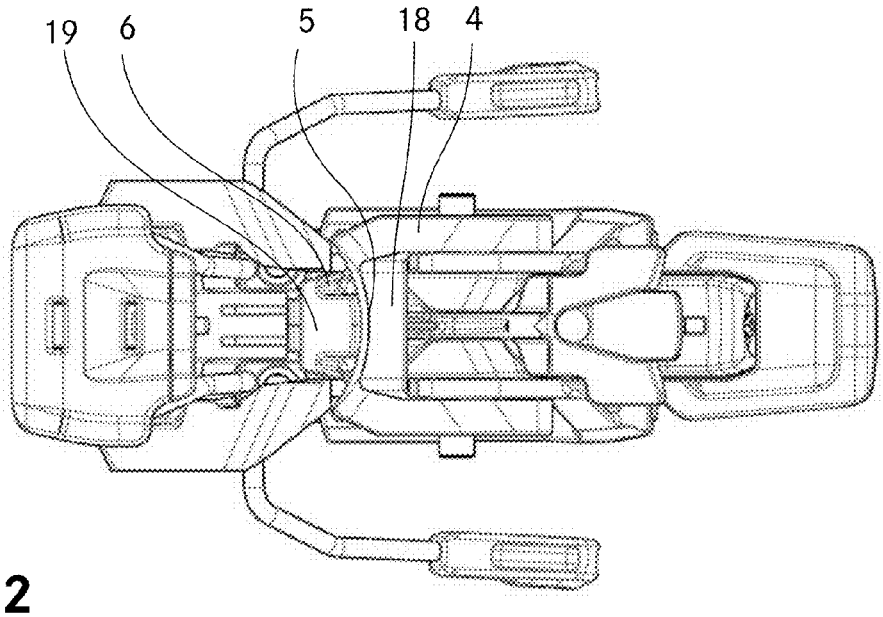
FIG. 2 shows a plan view of the automatic heel unit according to the invention in the release configuration.

FIG. 2 shows a plan view of the automatic heel unit 1 in the release configuration. In this view, the heel-supporting structure 6 can be seen on the front face of the connection web 18 of the heel retainer 4. Moreover, the tread spur 19 arranged underneath the overhangs can be clearly seen.

Figure 3A:
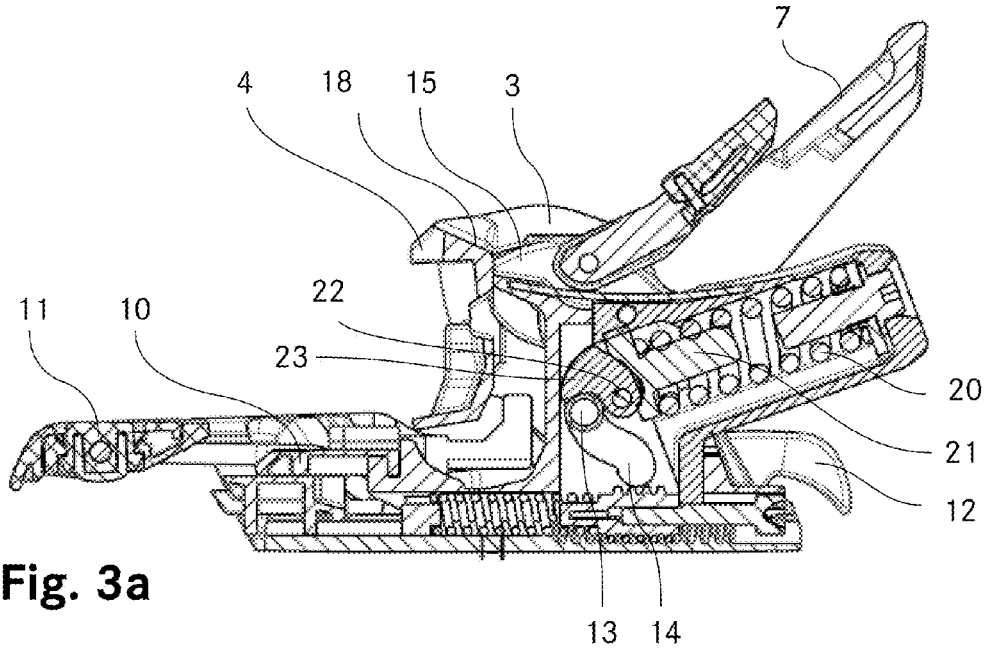
FIG. 3*a* shows a side view of a vertically oriented cross section running in the longitudinal direction of the ski through the automatic heel unit, in a holding configuration in which the heel retainer is located in a holding setting, and through the ski brake in a travel setting, wherein the cross section, seen in the transverse direction of the ski, extends centrally through the automatic heel unit.
Figure 3B:
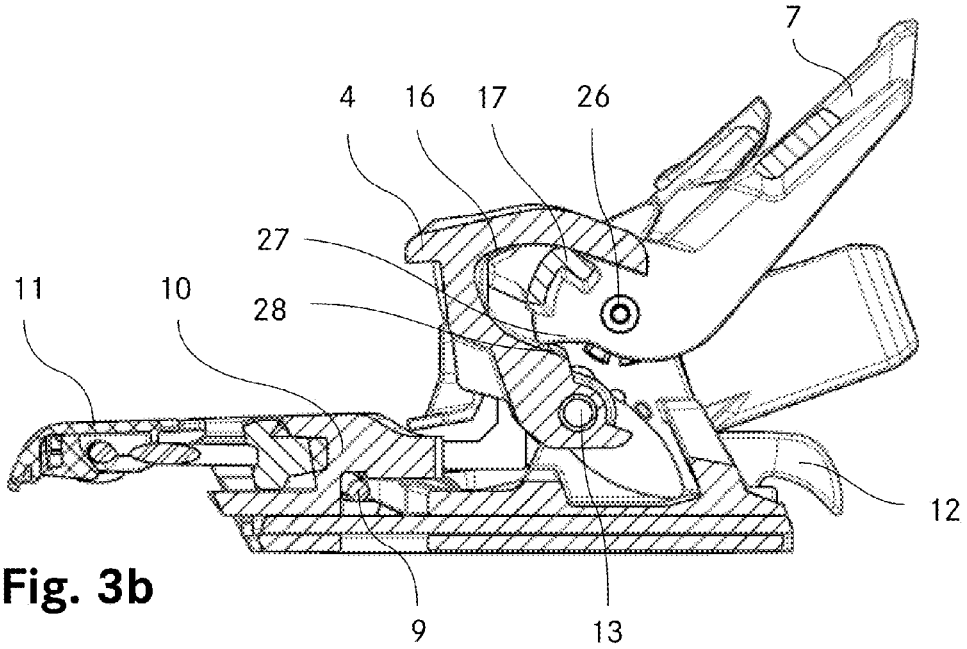
FIG. 3*b* shows a side view of a vertically oriented cross section running in the longitudinal direction of the ski through the automatic heel unit in the holding configuration, and through the ski brake in the travel setting, wherein the cross section, seen in the transverse direction of the ski, extends through a side wall of the heel retainer.

FIGS. 3*a* and 3*b* each show a side view of a vertically oriented cross section running in the longitudinal direction of the ski through the automatic heel unit 1, wherein the automatic heel unit 1 is located in the holding configuration. The construction of the automatic heel unit 1 can thus be better seen. In FIG. 3*a*, the cross section, seen in the transverse direction of the ski, extends centrally through the automatic heel unit 1. By contrast, in FIG. 3*b*, the cross section, seen in the transverse direction of the ski, extends at a slight offset behind the side wall of the heel retainer 4 directed toward the observer.

The heel retainer 4 is mounted movably on the heel retainer support 3 via a total of four bearing points. A first bearing point is formed by the aforementioned axle 13 which is oriented horizontally in the transverse direction of the ski and which is connected immovably to both side walls in a lower area of the side walls of the heel retainer 4. It will be noted in FIG. 3*a* that the heel retainer support 3 has a groove designed as an oblong hole 14 in which the axle 13 is guided. The oblong hole 14 comprises an upper, substantially vertical portion, and a lower, curved portion adjoining the vertical portion. This curved portion extends with two curvatures downward and rearward from the front. The axle 13 runs as a pin through the groove formed as oblong hole 14 in the heel retainer support 3 and is movable up and down along the shape of the oblong hole 14 relative to the heel retainer support 3.

A second bearing point of the heel retainer 4 on the heel retainer support 3 is formed by a lug 15, which is arranged in the front upper area of the heel retainer support 3 and on which the connection web 18 of the heel retainer 4 can be supported. The lug 15 of the heel retainer support 3 protrudes forward, seen in the longitudinal direction of the ski, and extends across a central area of the width of the heel retainer support 3, seen in the transverse direction of the ski. In the cross section shown in FIG. 3*a*, the connection web 18 of the heel retainer 4 has an upper slope extending downward from front to rear, a central vertical portion, and a lower slope extending downward from rear to front. Depending on the setting of the heel retainer 4, the lug 15 bears on the upper slope, the lower slope, or the vertical portion of the connection web 18. Therefore, the lug 15 supports the heel retainer 4 in another orientation relative to the heel retainer support 3 against a further rearward rotation movement with its upper area about the axle 13.

A third bearing point of the heel retainer 4 on the heel retainer support 3 is formed by the actuation lever 7. For this purpose, the heel retainer 4 has, in each of its two side walls, a recess 16 which is open toward the center of the ski, seen in the transverse direction of the ski. The recesses 16 each comprise an upper area and a lower area. These two areas each taper in the forward direction to a front, rounded tip of the respective recess 16, such that the recesses 16 have a C-shaped configuration in a vertical cross section through the heel retainer 4, as can be seen in FIG. 3*a*. The actuation lever 7 has a bracket shape. The areas of the two free ends of the bracket are each formed by a vertically oriented side wall. In a central area of these side walls, the actuation lever 7 is mounted on the heel retainer support 3 so as to be rotatable about an axle 26 oriented horizontally in the transverse direction of the ski. One side wall is located to the left and one to the right of the heel retainer support 3. At a distance from the axle 26, the two side walls each have a cam 17 which protrudes outward from the center of the ski, from the respective side wall, seen in the transverse direction of the ski, and which has a substantially triangular cross section. Depending on the position of the actuation lever 7, these cams 17 are located above, below or in front of the axle 27. As can be seen from FIG. 3*b*, the cams 17 are each arranged within the recess 16 of the side walls of the heel retainer 4. The cams 17 are in this case movable within the recess 16 relative to the heel retainer 4. When the actuation lever 7 is rotated about the axle 26, the cams 17 also execute a circular movement about the axle 26. The cams 17 each bear either on the upper or on the lower area of the corresponding recess 16 and, during a movement of the actuation lever 7, slide along the upper or lower area of the recess 16 and thereby press the heel retainer 4 upward and downward, respectively. The recess 16 on the heel retainer 4 is thus designed as a cam disk. A movement of the actuation lever 7 can thus be transmitted to the heel retainer 4. In the holding setting of the heel retainer 4, the cam 17 prevents a downward movement of the heel retainer 4 relative to the heel retainer support 3 and prevents a forward rotation movement of the heel retainer 4 about the axle 13.

The fourth bearing point of the heel retainer 4 on the heel retainer support 3 is also formed by the actuation lever 7. For this purpose, the two side walls of the actuation lever 7 each have a front surface 27, the latter forming the free ends of the arms of the bracket that forms the actuation lever 7. Depending on the position of the actuation lever 7, these front surfaces 27 are oriented downward or forward toward the tip of the ski. Both surfaces 27 interact with a respective web 28 arranged on the heel retainer 4. The two webs 28 are each arranged on the inner face of the side walls of the heel retainer 4, below the recesses 16 open toward the center of the ski as seen in the transverse direction of the ski (see FIGS. 3*b* and 5*b*). They are located above the axle 13. When the actuation lever 7 is rotated upward and forward about the axle 26, the surfaces 27 of the actuation lever 7 are pressed down onto the webs 28 of the heel retainer 4. The bearing point of the heel retainer 4, formed by the surface 27 of the actuation lever 7 and the webs 28 of the heel retainer 4, therefore prevents an unintentional upward movement of the heel retainer 4.

The heel retainer 4 is movable along the adjustment path relative to the heel retainer support 3 by means of these four bearing points. The oblong hole 14 with the guided axle 13 of the first bearing point, the lug 15 of the heel retainer support 3 with the connection web 18 of the heel retainer 4 of the second bearing point, the recesses 16 of the heel retainer 4 with the cams 17 of the actuation lever 7 of the third bearing point, and the surfaces 27 of the actuation lever 7 with the webs 28 of the heel retainer 4 of the fourth bearing point therefore form a heel retainer guide, by which the heel retainer 4 is mounted on the heel retainer support 3 movably along the first area of the adjustment path of the heel retainer 4 relative to the heel retainer support 3 from its holding setting to its walking setting and back again or from its holding setting to its release setting and back again. The heel retainer guide is in this case a positive control of the heel retainer 4.

The recesses 16 of the heel retainer 4 with the cams 17 of the actuation lever 7 of the third bearing point and the surfaces 27 of the actuation lever 7 with the webs 28 of the heel retainer 4 of the fourth bearing point additionally form an actuation lever guide for transmitting a movement of the actuation lever to the heel retainer 4. The actuation lever 7 is coupled to the heel retainer 4 by this actuation lever guide such that a movement of the actuation lever 7 can be transmitted to the heel retainer 4 and, conversely, a movement of the heel retainer 4 can be transmitted to the actuation lever 7.

In FIGS. 3*a* and 3*b*, the automatic heel unit 1 is shown in the holding configuration and, consequently, the heel retainer 4 is shown in its holding setting. The axle 13 is in this case located in a central area of the oblong hole 14, i.e. in a transition area between the upper vertical portion and the lower curved portion of the oblong hole 14 (see FIG. 3*a*). Moreover, the vertical portion of the connection web 18 of the heel retainer 4 bears on the front face of the lug 15 of the heel retainer support 3. The heel retainer 4 is thus inclined slightly forward with its upper area and cannot be freely rotated rearward with its upper area about the axle 13. Moreover, in the holding setting of the heel retainer 4, the cams 17 of the actuation lever 7 bear on the upper area of the recesses 16 (see FIG. 3*b*). Since the upper area of the recesses 16 slopes downward to the rear, the heel retainer 4, on account of the cam 17 lying on the upper area of the recesses 16, also cannot be freely rotated forward with its upper area about the axle 13. Moreover, the cams 17 prevent the heel retainer 4 from executing a free downward movement. Furthermore, the webs 28 of the heel retainer 4 bear on the surfaces 27 of the actuation lever 7. In this way, the heel retainer 4 also cannot be moved freely upward.

The heel retainer 4 has in its rear area, and centrally when seen in the transverse direction of the ski, a recess with a circular cross section. A longitudinal axis of this recess forms an acute angle to the vertical, seen from the rear toward the front. It will be noted in FIG. 3*a* that a piston 21 is located in the recess. This piston 21 is mounted movably and bears with its front face on a detent 23. The rear face of the piston 21 is adjoined by an elastic element in the form of a spring 20. This spring 20 is supported with its front end against the piston 21 and with its rear end against a disk. The disk is secured on the heel retainer support 3 by a screw. This screw can be used to adjust the pretensioning with which the spring 20 presses the piston 21 against the detent 21. On its front face, the piston 21 has an inwardly curved surface which, in the holding setting of the heel retainer 4, bears on a corresponding curvature of the detent 23. The detent 23 is mounted on the heel retainer support 3 so as to be pivotable about an axle 22 and is located between the piston 21 and the axle 13 guided in the oblong hole 14. It has an arc-shaped area with which it bears on the axle 13 and in so doing partially encloses the axle 13.

When the automatic heel unit 1, as shown in FIGS. 3*a* and 3*b*, is located in the holding configuration in which the heel retainer 4 is located in its holding setting and the heel retainer 4 holds a heel area (not shown here) of a ski boot in the automatic heel unit 1 in a lowered position, the spring 20 is compressed and thereby pretensioned. It therefore generates a force which is transmitted by the piston 21 to the detent 23. Since the force from the piston 21 acts on the detent 23 above the bearing of the detent 23, the detent 23 is pressed downward about the axle 22 and the arc-shaped area of the detent 23 is pressed onto the axle 13. The force transmission from the spring 20 to the heel retainer 4 thus takes place via the detent 23.

As has already been mentioned, the axle 13, in the holding configuration of the automatic heel unit 1, is located at a transition between the upper vertical portion and the lower curved portion of the oblong hole 14. In its holding setting, the heel retainer 4 is located on a transition from the first area of the adjustment path to the second area of the adjustment path. Starting from the holding setting, the heel retainer 4 can be moved downward into the first area of the adjustment path and vertically upward into the second area of the adjustment path. When the heel retainer 4 is located in a partial area of the second area of the adjustment path adjacent to the first area of the adjustment path, the heel retainer 4 is pretensioned downward to the holding setting on account of the force generated by the spring 20 and transmitted from the piston 21 to the axle 13 via the detent 23 and on account of the substantially vertical positive guidance of the axle 13 in the oblong hole 14. Moreover, since the longitudinal axis of the recess in which the spring 20 is located forms an acute angle to the vertical as seen from the rear forward, this means that, at each position of the heel retainer 4 in the partial area of the second area of the adjustment path, the force generated by the spring 20 is oriented at an acute angle to an orientation of the second area of the adjustment path at the respective position of the heel retainer 4.

The ski brake 8 can additionally be seen in FIGS. 3*a* and 3*b*. In the holding configuration of the automatic heel unit 1, the ski brake 8 is located in the downhill position. In this downhill position, the ski brake 8 is adjustable from a braking setting to a travel setting and back again. In the holding configuration of the automatic heel unit 1, when a ski boot (not shown here) is held in the automatic heel unit 1, the ski brake 8 is located in the travel setting as shown in FIGS. 3*a* and 3*b*. In this travel setting, the arms 12 are located in a horizontal orientation, and the free ends of the arms 12 point horizontally rearward. The heel area of the ski boot (not shown here) held in the automatic heel unit 1 secures the actuation element 11 of the ski brake in a lower position, such that the top face of the actuation element 11 forms a surface with the bearing element 10. As soon as the ski boot is released from the automatic heel unit 1, the space above the actuation element 11 is free and the ski brake 8 is able to adjust itself from the travel setting to the braking setting.

In order to adjust the automatic heel unit 1 from its holding configuration to its walking configuration, the actuation lever 7 is moved from its holding position to its first walking position. This is achieved by the fact that the free end of the actuation lever 7 pointing obliquely rearward and upward in the holding setting is moved upward. In this way, the heel retainer 4 is moved downward and rearward along the first area of the adjustment path from its holding setting to its walking setting. The heel retainer 4 can in this case be moved from its holding setting to its walking setting only on the first area of the adjustment path, when the heel area of the ski boot is not placed in the automatic heel unit 1.

During the movement of the free end of the actuation lever 7 from the holding position to the walking position, the opening lever 7 is rotated about the axle 26. As a result of this rotation movement, the surfaces 27 of the actuation lever 7 pivot downward and press from above onto the webs 28 of the heel retainer 4. Since the heel retainer 4 is guided via the axle 13 in the oblong hole 14, the heel retainer 4 can only move along the oblong hole 14 down into the lower curved portion of the oblong hole 14. The heel retainer 4 is moved rearward and downward by this guiding. Shortly before the actuation lever 7 is located in its first walking position, the webs 28 of the heel retainer bear on an end of the surfaces 27 of the actuation lever 7. The surfaces 27 can thus no longer interact with the webs 28. However, as a result of the rotation movement of the actuation lever 7, the cams 17 have in the meantime moved to the lower area of the recesses 16 and bear on this lower area. When the actuation lever 7 is rotated farther upward to its first walking position, the cams 17 of the actuation lever 7 therefore move farther downward and in so doing press from above onto the lower area of the recesses 16. In this way, the heel retainer 4 is pressed farther downward and the axle 13 moves to the lower end of the curved portion of the oblong hole 14. The cams 17 are guided forward along the recesses 16 of the heel retainer 4 until they are located in the front, rounded tip of the recesses 16.

At the start of this movement of the heel retainer 4 downward from its holding setting, the connection web 18 of the heel retainer bears with its vertical portion on the front face of the lug 15 of the heel retainer support 3. However, when the heel retainer 4 is moved down until the vertical portion is no longer in contact with the front face of the lug 15, the upper slope of the connection web 18 bears on an underside of the lug 15. In this partial area of the first area of the adjustment path, the heel retainer moves downward and at the same time rearward. The heel retainer is thus movable from its holding setting to its walking setting with a curved linear movement along the first area of the adjustment path, although it is at the same time pivoted slightly forward with its upper area. The first area of the adjustment path extends in a plane oriented vertically in the longitudinal direction of the ski.

During the entire movement of the heel retainer 4 from its holding setting to its walking setting and back again along the first area of the adjustment path, the heel retainer 4 is freely movable along the first area of the adjustment path. The heel retainer is thus movable without pretensioning, i.e. without the force generated by the spring 20 and acting on the heel retainer 4. The reason for this lies in the shape of the detent 23 and in the position of the detent 23 when the axle 13 is located in the lower curved portion of the oblong hole 14. When the axle 13 is located in the curved portion of the oblong hole 14, the detent 23 is in fact oriented such that, on account of the force generated by the spring 20, the front area of the piston 21 presses onto a shoulder of the detent 23 located between piston 21 and axle 22. The force is directed to the center of the axle 22. In this way, no torque acts on the detent 23, and the arc-shaped area of the detent 23 does not transmit any force to the axle 13. The heel retainer 4 is thus not pretensioned along the first area of the adjustment path. It can therefore be moved by the actuation lever 7, or manually by hand, along the first area of the adjustment path.

Figure 4A:
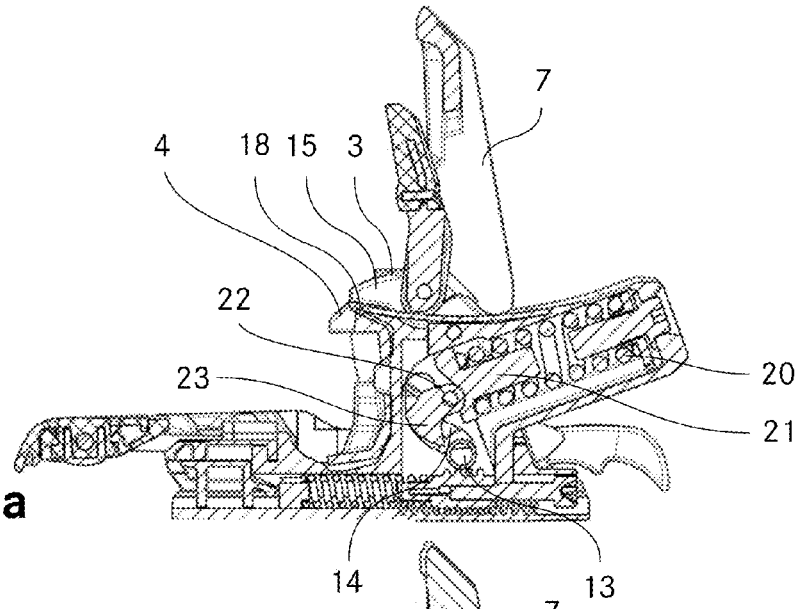
FIG. 4*a* shows a side view of a vertically oriented cross section running in the longitudinal direction of the ski through the automatic heel unit in a walking configuration, and through the ski brake in the travel setting, wherein the cross section, seen in the transverse direction of the ski, extends centrally through the automatic heel unit.
Figure 4B:
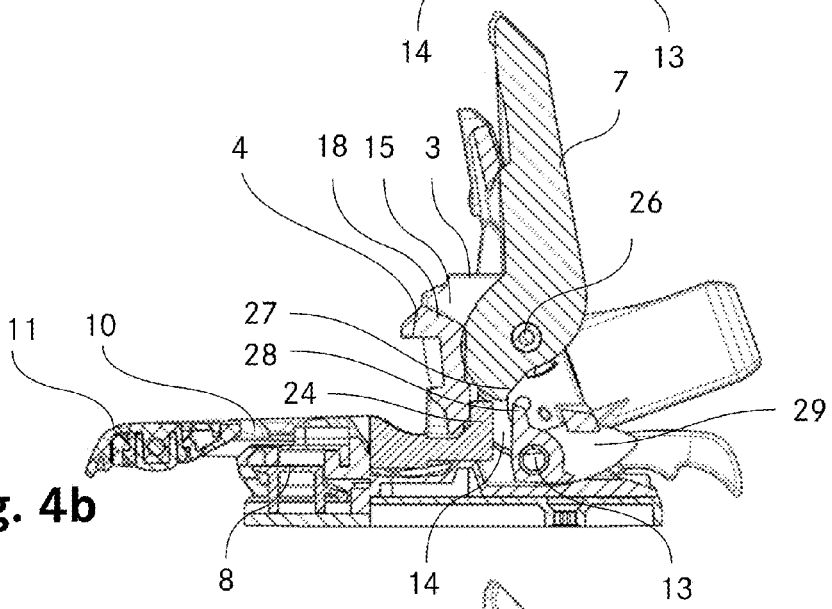
FIG. 4*b* shows a side view of a vertically oriented cross section running in the longitudinal direction of the ski through the automatic heel unit in the walking configuration, and through the ski brake in the travel setting, wherein the cross section, seen in the transverse direction of the ski, extends behind the side wall of the heel retainer.
Figure 4C:
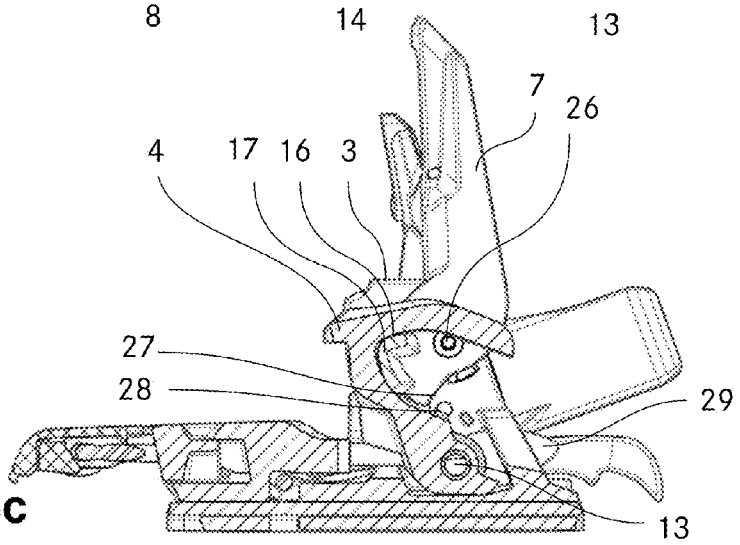
FIG. 4*c* shows a side view of a vertically oriented cross section running in the longitudinal direction of the ski through the automatic heel unit in the walking configuration, and through the ski brake in the travel setting, wherein the cross section, seen in the transverse direction of the ski, extends through the side wall of the heel retainer.

FIGS. 4*a*-4*c* each show a side view of a cross section, oriented vertically in the longitudinal direction of the ski, through the automatic heel unit 1 in the walking configuration. In FIG. 4*a*, the cross section, seen in the transverse direction of the ski, extends centrally through the automatic heel unit 1. In FIG. 4*b*, the cross section, seen in the transverse direction of the ski, extends, at an offset to the center of the ski, through a side wall of the actuation lever 7. By contrast, in FIG. 4*c*, the cross section, seen in the transverse direction of the ski, extends, at an offset to the center of the ski, behind the side wall of the heel retainer directed toward the observer.

In the illustrated walking configuration of the automatic heel unit 1, the actuation lever 7 is located in its first walking position and the free end of the actuation lever 7 points vertically upward. In this position, the cams 17 of the actuation lever 7 lie with two of their sides firmly in the front rounded tip of the recesses 16 of the heel retainer 4 (see FIG. 4*c*). The actuation lever 7 is thus located in a stable position.

Furthermore, in the walking configuration of the automatic heel unit 1, the heel retainer 4 is located in its walking setting. The connection web 18 of the heel retainer 4 bears with its upper slope on the underside of the lug 15 of the heel retainer support 3. In this way, the heel retainer 4 is prevented from moving upward and from rotating rearward about the axle 13. Moreover, in the walking setting of the heel retainer 4, the front lower area of the heel retainer 4 bears on the heel retainer support 3, as can be seen from FIG. 4*a*, such that the heel retainer 4 cannot rotate forward about the axle 13. Since the heel retainer 4 is located in a rear and lower position and the axle 13 is located at the lower end of the curved portion of the oblong hole 14, the heel retainer 4 cannot be moved any farther rearward and downward. In its walking setting, the heel retainer 4 is located farther rearward and farther downward than in its holding setting. When the automatic heel unit 1 therefore forms a ski binding together with an automatic front unit, the heel area of the ski boot held in the automatic front unit can be lowered toward the ski in the walking configuration of the automatic heel unit 1, until it is either supported by the front area of the heel retainer support 3 or by the bearing element 10 of the ski brake 8 and is prevented from lowering any farther. However, the ski boot is not locked in the lowered position by the heel retainer 4 and instead can be lifted upward again from the automatic heel unit 1.

It will additionally be seen in FIGS. 4*b* and 4*c* that the automatic heel unit 1, on both sides of the heel retainer support 3, has a covering 29 between heel retainer 4 and heel retainer support 3 in order to cover the oblong hole 14 from the outside. The coverings 29 have an oval shape and are mounted rotatably on the axle 13. Thus, the coverings 29 move with the heel retainer 4. As is shown in both of FIGS. 4*b* and 4*c*, the coverings 29 are pushed rearward in the walking setting of the heel retainer, in which position the axle 13 is located in the lowest area of the oblong hole 14. The coverings are in each case guided by a clip on the heel retainer support 3.

As has already been mentioned, the heel retainer 4 is movable from its walking setting along the first area of the adjustment path back to its holding setting. To do this, the actuation lever 7 is moved from its first walking position to its holding position. For this purpose, the freely vertically upwardly pointing end of the actuation lever 7 is moved obliquely rearward from above. In this way, the cams 17 of the actuation lever 7 pivot upward about the axle 26, wherein the cams 17 slide along the upper area of the recesses 16 of the heel retainer 4 and thus press the heel retainer 4 upward. When the actuation lever 7 is moved from its first walking position to its holding position, the axle 13 therefore moves upward along the lower curved portion of the oblong hole 14. Moreover, the upper slope of the connection web 18 of the heel retainer 4 is initially guided obliquely forward and upward along the underside of the lug 15 of the heel retainer support 3. Shortly before the holding setting of the heel retainer 4, the heel retainer 4 is moved forward to such an extent that the front face of the lug 15 of the heel retainer support 3 bears on the central vertical portion of the connection web 18 of the heel retainer 4. The heel retainer 4 thus executes an upward and forward movement along the first area of the adjustment path.

Starting from the walking setting of the heel retainer 4, the heel retainer 4 is movable along the first area of the adjustment path, beyond its holding setting, upward from the first area of the adjustment path into the second area of the adjustment path separate from the first area of the adjustment path and adjoining the first area of the adjustment path. In a transition area from the first area to the second area, the adjustment path of the heel retainer 4 has no bend and can therefore be continuously differentiated.

The heel retainer 4 is adjustable from the holding setting to the release setting along the second area of the adjustment path. Such an adjustment can be effected by actuation of the actuation lever 7. However, it can also take place in a forward direction in the case of a safety release permitted by the automatic heel unit 1. In this case, when there is an impact on the ski boot, the ski binding or the ski, the energy that can be taken up by the automatic heel unit 1, before a safety release takes place in the forward direction, depends on the force of the spring 20 and on the length of the vertically oriented partial area of the second area of the adjustment path adjoining the first area of the adjustment path.

In order to adjust the automatic heel unit 1 from its walking configuration to its release configuration by the actuation lever 7, the actuation lever 7 is adjusted from its first walking position to its release position. In this way, the heel retainer 4 is adjusted from its holding setting to its release setting. From the transition from the lower curved portion of the adjustment path to the upper, substantially vertical portion of the oblong hole 14, the axle 13 of the heel retainer 4 moves upward into the upper, substantially vertical portion of the oblong hole 14. After the transition from the first area to the second area of the adjustment path, the heel retainer 4 is moved upward substantially rectilinearly.

At the transition from the first area of the adjustment path into the second area of the adjustment path, the axle 13 of the heel retainer 4 presses the detent 23 upward, such that the latter is pivoted rearward about the axle 22. In this way, the piston 21 pretensioned by the spring 20 no longer bears on the shoulder of the detent 23 but on the arc-shaped area of the detent 23. The detent 23 can thereby transmit a torque. When the heel retainer 4 is moved upward farther along the second area of the adjustment path, the detent 23 is pivoted farther rearward about the axle 22. In this way, the arc-shaped area of the detent 23 presses the piston 21 rearward and upward, such that the spring 20 is further compressed. This means that the heel retainer 4, for adjustment from its holding setting to its release setting, initially has to be moved upward, counter to the force generated by the pretensioned spring 20, along the partial area of the second area of the adjustment path adjoining the first area of the adjustment path. Thus, in this partial area of the second area of the adjustment path, the heel retainer 4 is pretensioned toward its holding setting by the spring 20. In this partial area, the connection web 18 of the heel retainer 4 is supported with its vertical portion along the front face of the lug 15 of the heel retainer support 3. At the upper edge of the partial area, the heel retainer 4 is moved upward to such an extent that the connection web 18 is moved with its vertical portion out past the front face of the lug 15. In this way, the heel retainer 4 is located in a further partial area of the second area of the adjustment path. When the heel retainer 4, in this further partial area of the adjustment path, is moved onward, the axle 13 in the oblong hole 14 is moved slightly downward, while the heel retainer 4 is at the same time pivoted rearward about the axle 13 until the connection web 18 bears with its lower bevel on an upper face of the lug 15 of the heel retainer support 3 and the heel retainer 4 is located in its release setting. The piston 21 is moved slightly forward again over the detent 23, and the tension of the spring 20 is thereby reduced. The heel retainer 4 is thus pretensioned toward its release setting after the rearward pivoting movement. In this way, the heel retainer 4 cannot unintentionally come loose from its release setting. By virtue of these kinematics, the heel retainer 4 cannot unintentionally come loose from its holding setting, and it also cannot unintentionally come loose from its release setting. Moreover, by way of the pretensioned spring 20, the automatic heel unit 1 permits a safety release in the forward direction. If, in the event of a fall, the energy acting on the ski boot, the ski or the ski binding is greater than the force generated by the pretensioned spring 20, and pretensioning the heel retainer 4 toward the holding setting, multiplied by the length of the vertical partial area of the second area of the adjustment path in which the heel retainer 4 is pretensioned toward the holding setting, a safety release is effected by means of the heel retainer 4 being adjusted from its holding setting to its release setting. In this way, the heel area of the ski boot is freed from the automatic heel unit 1. For example, such a safety release of a heel retainer having similar kinematics is also described in WO 96/23559 A1 (Fritschi AG Apparatebau). In the event of a fall, the energy that can be taken up by the automatic heel unit 1 before a safety release is effected can be adjusted by the pretensioning of the spring 20 by means of the screw in the rear end of the recess.

As has been mentioned, the above-described movement profile of the heel retainer 4 along the second area of the adjustment path can be effected by actuation of the actuation lever 7 or by a safety release. When the heel retainer 4 is adjusted from its holding setting to its release setting by the actuation lever 7, the free, upwardly pointing end of the actuation lever 7 is rotated downward about the axle 26. In this way, the cams 17 of the actuation lever 7 are pivoted rearward and upward. The tips of the cams 17 thus press upwardly and rearwardly on the upper area of the recesses 16. The heel retainer 4 is thus moved upward until the connection web 18 is moved with its vertical portion past the front face of the lug 15. Thereafter, the heel retainer 4 pivots rearwardly about the axle 13 until the connection web 18 bears with its lower bevel on an upper face of the lug 15 of the heel retainer support 3. As can be seen from FIG. 5*c*, the reason for the rearward pivoting movement of the heel retainer 4 lies in the cams 17 which, on account of the shape of the recesses 16 of the heel retainer 4, not only press the heel retainer 4 upward but also rearward.

The heel retainer 4 is thus movable substantially linearly along the second area of the adjustment path. By the movement of the actuation lever 7 from its holding position to its release position and back again, the automatic heel unit 1 is adjustable from the holding configuration to the release configuration and back again. Moreover, by the movement of the actuation lever 7 from the first walking position to the release position and back again, the automatic heel unit 1 is adjustable from the walking configuration to the release configuration and back again. As has been mentioned, the automatic heel unit 1 moreover permits a safety release in the forward direction by the pretensioned spring 20. In this case, the automatic heel unit 1 is adjustable by the heel area of the ski boot from the holding configuration to the release configuration.

Regardless of whether the automatic heel unit 1 is adjusted from the holding configuration to the release configuration by adjustment of the actuation lever 7 or by a safety release, the second area of the adjustment path of the heel retainer 4 extends in a plane that is oriented vertically in the longitudinal direction of the ski.

As has been described above, the automatic heel unit 1 can be adjusted from the holding configuration to the release configuration in the case of a safety release. At the start of this adjustment process, the heel retainer 4 is moved upward from its holding setting, by the heel area of the ski boot held in the automatic heel unit 1, along the partial area of the adjustment path adjoining the first area of the adjustment path. Thus, the heel area of the ski boot no longer keeps the actuation element 11 of the ski brake 8 down. Since the actuation element 11 of the ski brake 8 is pretensioned in the upward direction, the actuation element 11 pivots upward when the heel area of the ski boot is lifted. The free ends of the arms 12 move downward. The ski brake 8 is thereby adjusted from the travel setting to the braking setting. The braking position of the ski brake 8 can be seen in FIGS. 5*a*-5*c*.

However, the automatic heel unit 1 can also be adjusted from its release configuration to its holding configuration by means of the heel area of the ski boot being inserted into the automatic heel unit 1. If the heel area of the ski boot is in this case lowered toward the ski, the heel retainer 4 is also adjusted from its release setting to its holding setting. During such an insertion of the ski boot, the sole of the ski boot at a certain point makes contact with the upper face of the actuation element 11 of the ski brake 8 and presses it downward. In this way, the free ends of the arms 12 are rotated upward about the axle 9 into a horizontal orientation, and the ski brake 8 is adjusted from the braking setting to the travel setting.

As has already been mentioned, the ski brake 8 is coupled to the heel retainer 4, as a result of which the ski brake 8 can be moved from its downhill position to its walking position and back again by a movement of the heel retainer 4. As can be seen from FIG. 4*b*, the bearing element 10 of the ski brake 8 has a driver 24 for this purpose. This driver 24 is arranged in a rear area of the bearing element 10. The driver 24 has an upwardly facing protuberance, wherein the driver 24 passes under the heel retainer 4 and, seen in the longitudinal direction of the ski, the protuberance is located behind the connection web 18 of the heel retainer 4. When the heel retainer 4 is moved rearward and downward from its holding setting along the first area of the adjustment path, the heel retainer 4 pulls the protuberance of the driver 24, and therefore the bearing element 10, toward the rear via the connection web 18. The ski brake 8 is thereby moved in translation from its front downhill position to its rear walking position. In this walking position, the ski brake 8 can be locked in the braking setting by a brake holder arranged on the base plate 2. When the heel retainer 4 is moved forward and upward from its walking setting to its holding setting along the first area of the adjustment path, the driver 24 and the bearing element 10 are moved forward by the heel retainer 4. The ski brake 8 is thereby adjusted from its walking position to its downhill position.

Figure 5A:
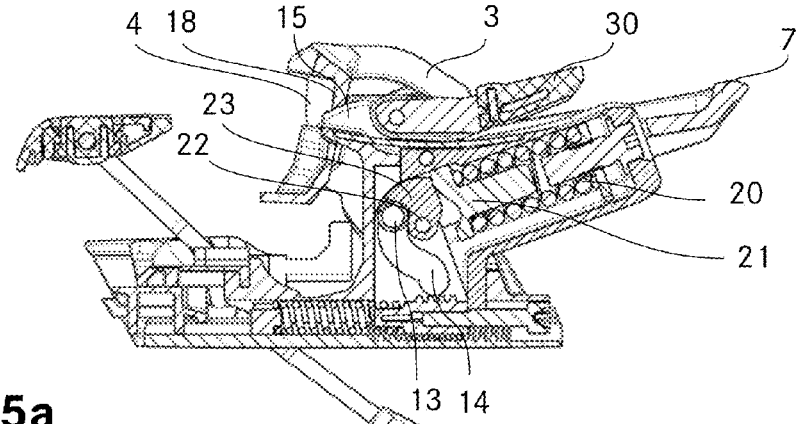
FIG. 5*a* shows a side view of a vertically oriented cross section running in the longitudinal direction of the ski through the automatic heel unit in the release configuration, and through the ski brake in the braking setting, wherein the cross section, seen in the transverse direction of the ski, extends centrally through the automatic heel unit.
Figure 5B:
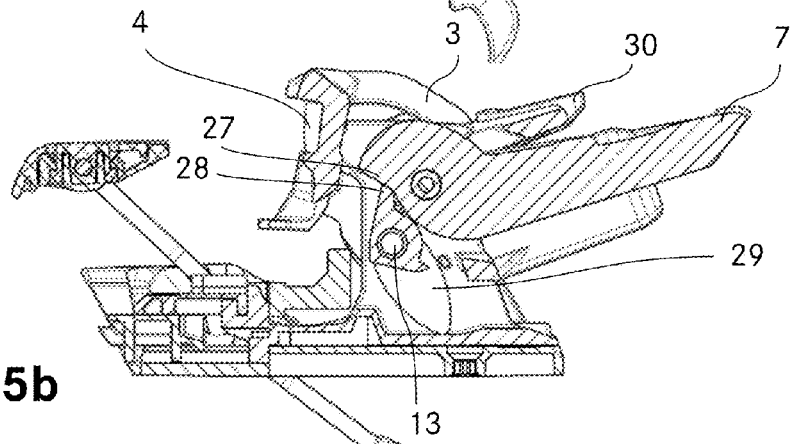
FIG. 5*b* shows a side view of a vertically oriented cross section running in the longitudinal direction of the ski through the automatic heel unit in the release configuration, and through the ski brake in the braking setting, wherein the cross section, seen in the transverse direction of the ski, extends behind the side wall of the heel retainer.
Figure 5C:
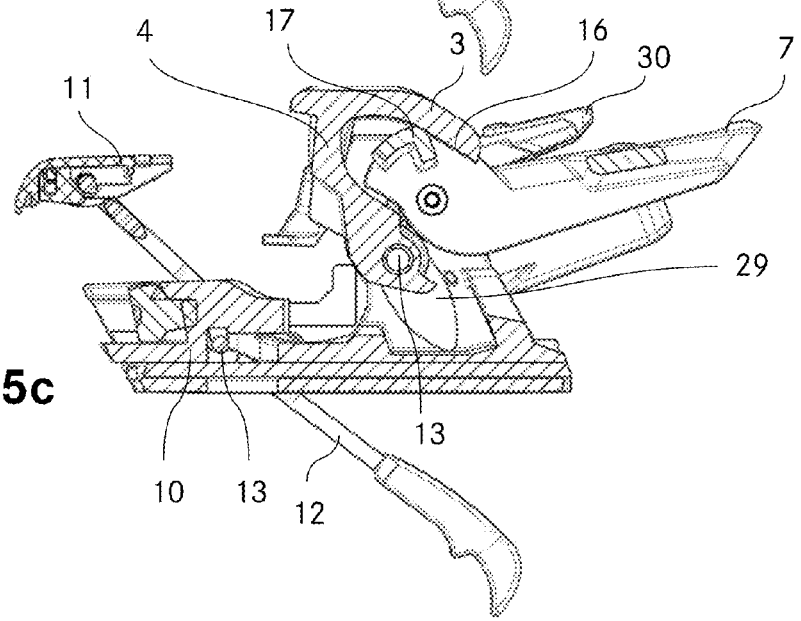
FIG. 5*c* shows a side view of a vertically oriented cross section running in the longitudinal direction of the ski through the automatic heel unit in the release configuration, and through the ski brake in the braking setting, wherein the cross section, seen in the transverse direction of the ski, extends through the side wall of the heel retainer.

FIGS. 5*a*-5*c* each show a side view of a cross section, oriented vertically in the longitudinal direction of the ski, through the automatic heel unit 1 in the release configuration. In FIG. 5*a*, the cross section, seen in the transverse direction of the ski, extends centrally through the automatic heel unit 1. In FIG. 5*b*, the cross section, seen in the transverse direction of the ski, extends at an offset from the center of the ski and through a side wall of the actuation lever 7. By contrast, in FIG. 5*c*, the cross section, seen in the transverse direction of the ski, extends at an offset to the center of the ski and behind the side wall of the heel retainer 4 directed toward the observer.

In the release configuration of the automatic heel unit 1, the actuation lever 7 is located in its release position. The free end of the actuation lever 7 is in this case oriented approximately horizontally. In this position, the cams 17 of the actuation lever 7 are located in the rear upper area of the recesses 16 of the heel retainer 4. Since this rear upper area of the recesses 16 slopes down toward the rear, the cams 17 prevent the heel retainer 4 from executing a forward rotation movement about the axle 13. Moreover, in the release setting of the heel retainer 4, the webs 28 of the heel retainer 4 bear on a rear end of the surfaces 27 of the actuation lever 7.

In the release setting of the heel retainer 4, the axle 13 is located in the upper vertical portion of the oblong hole 14. In this way, the detent 23 is rotated upward about the axle 22, and the piston 21 is located in a rear upper position. The spring 20 is thus compressed to the greatest extent in the release position by comparison with the other settings of the heel retainer 4. Moreover, in the release setting of the heel retainer 4, the lower bevel of the connection web 18 of the heel retainer 4 bears on the upper face of the lug 15 of the heel retainer support 3, as can be seen in FIG. 5*a*. Thus, the heel retainer 4 is prevented from executing a rearward rotation movement about the axle 13. It will also be seen in FIGS. 5*b* and 5*c* that the coverings 29 cover the oblong hole 14 in the release setting of the heel retainer 4. Since the coverings 29 are connected to the axle 13, they are moved upward with the heel retainer 4 when the heel retainer 4 is moved from its walking setting or from its holding setting to its release setting.

The automatic heel unit 1 can be adjusted from the release configuration to the holding configuration both with the actuation lever 7 and also with the ski boot. In both cases, the heel retainer 4 is initially moved slightly upward to its release setting with the axle 13 counter to the pretensioning and pivoted slightly forward about the axle 13 until the connection web 18 of the heel retainer 4 bears with its vertical portion on the front face of the lug 15 of the heel retainer support 3. The heel retainer 4 is then located in the partial area of the second area of the adjustment path adjoining the first area of the adjustment path and is pretensioned toward its holding setting.

When the automatic heel unit 1 is adjusted from the release configuration to the holding configuration with the actuation lever 7, the free end of the actuation lever 7 is moved upward about the axle 26. The actuation lever 7 thus presses with the surfaces 27 onto the webs 28 of the heel retainer 4 and thereby initially pivots the heel retainer 4 forward about the axle 13 and thereafter moves the heel retainer 4 downward. The axle 13 of the heel retainer 4 initially moves slightly upward in the oblong hole 14 and thereafter from the top downward along the vertical portion of the oblong hole 14. If a ski boot is inserted into the automatic heel unit 1, then, during the forward pivoting of the heel retainer 4 about the axle 13, said heel retainer 4 is guided from above onto the heel area of the ski boot.

When the automatic heel unit 1 is adjusted with the ski boot from the release configuration to the holding configuration, the heel area of the ski boot is inserted into the heel retainer 4, such that the holding-down structure 5 and the heel-supporting structure 6 of the heel retainer 4 can interact with the heel area of the ski boot. The front area of the heel retainer 4 is pressed downward via the tread spur 19 of the heel retainer 4. In this way, the heel retainer 4 is initially pivoted forward with its upper area until the whole heel retainer 4 can be moved downward to its holding setting. The upper area of the recess 16 presses onto the cams 17 of the actuation lever 7, such that the actuation lever 7 is adjusted about the axle 26 from the release position to the holding position.

Irrespective of the above-described adjustability of the heel retainer 4, the heel retainer support 3 is pretensioned in the forward direction relative to the base plate 2 by a spring force and can be moved toward the rear counter to this spring force. This permits the compensation of changes of distance between an automatic front unit and the automatic heel unit 1, which changes may arise upon bending of a ski. In this way, when skiing with the automatic heel unit 1 in the holding configuration and with a ski boot held in the ski binding, jamming of the ski boot between automatic front unit and automatic heel unit 1 is prevented when the rear end and the front end of the ski are bent upward. Accordingly, a reliable safety release is permitted with the automatic heel unit 1 in all travel situations. The mechanism with the spring for generating the forward pretensioning of the heel retainer support 3 is arranged in the base plate 2 below the oblong hole 14 of the heel retainer support 3.

Figure 6:
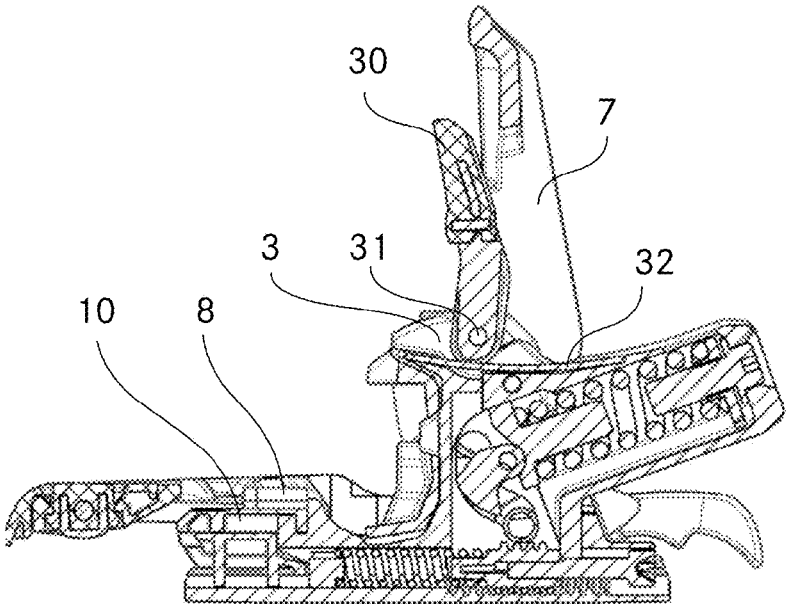
FIG. 6 shows a side view of a vertically oriented cross section running in the longitudinal direction of the ski through the automatic heel unit in the walking configuration, wherein the cross section, seen in the transverse direction of the ski, extends centrally through the automatic heel unit.
Figure 7:
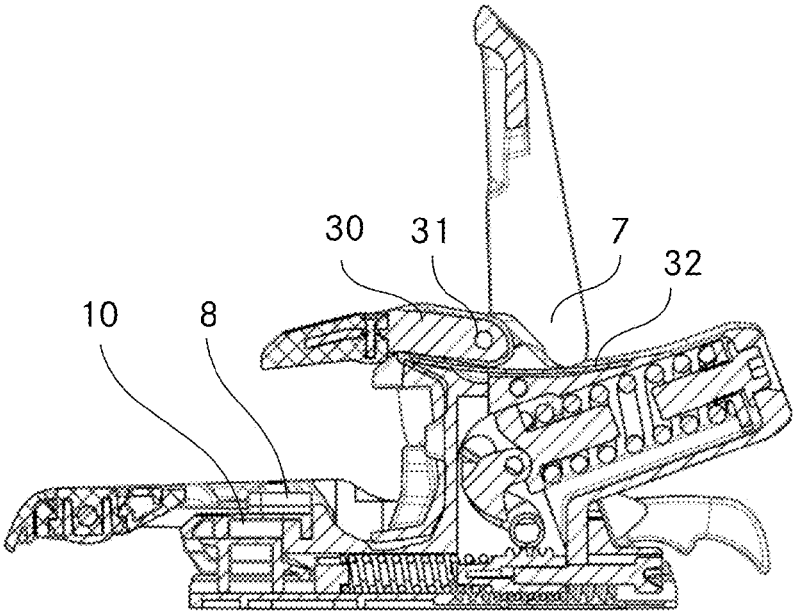
FIG. 7 shows a side view of a vertically oriented cross section running in the longitudinal direction of the ski through the automatic heel unit in the walking configuration, with a climbing aid lever in an activated setting, wherein the cross section, seen in the transverse direction of the ski, extends centrally through the automatic heel unit.
Figure 8A:
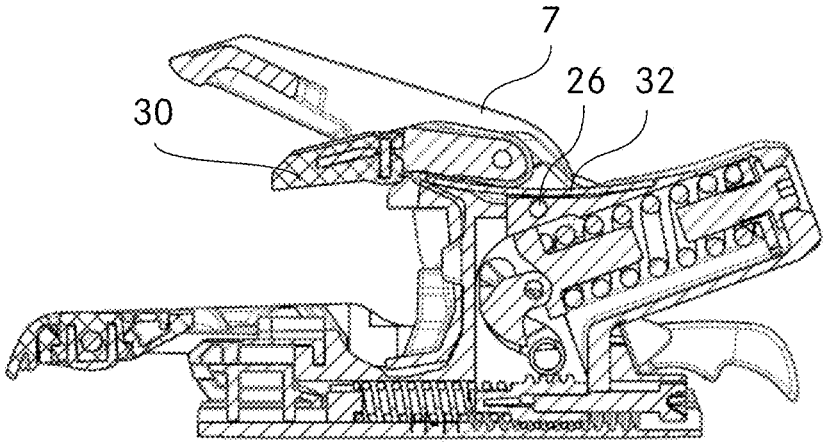
FIG. 8*a* shows a side view of a vertically oriented cross section running in the longitudinal direction of the ski through the automatic heel unit in the walking configuration, with the actuation lever in a second walking position, wherein the cross section, seen in the transverse direction of the ski, extends centrally through the automatic heel unit.

FIGS. 6, 7 and 8*a* each show a side view of a vertically oriented cross section running in the longitudinal direction of the ski through the automatic heel unit 1 in the walking configuration, and through the ski brake 8 in the travel position, wherein the cross section, seen in the transverse direction of the ski, extends centrally through the automatic heel unit 1.

Figure 8B:
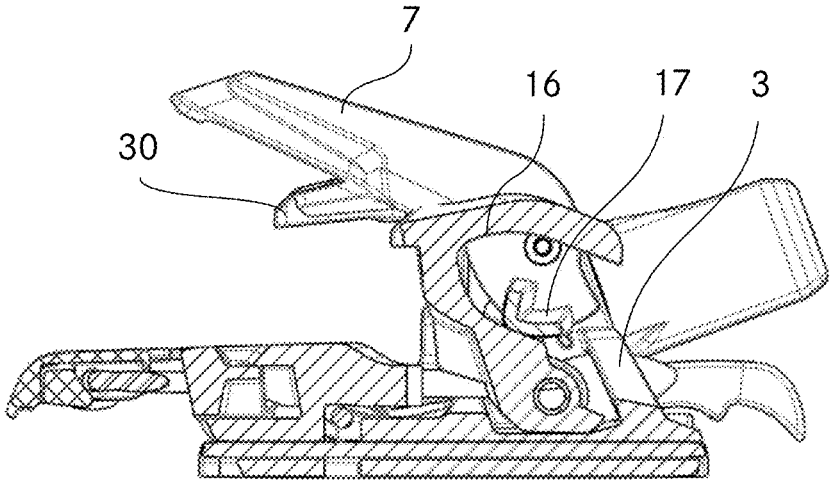
FIG. 8*b* shows a side view of a vertically oriented cross section running in the longitudinal direction of the ski through the automatic heel unit in the walking configuration, with the actuation lever in the second walking position, wherein the cross section, seen in the transverse direction of the ski, extends through the side wall of the heel retainer.

In the automatic heel unit 1 shown in FIG. 6, the actuation lever 7 is in its first walking position. A first climbing aid in the form of an elongate climbing aid lever 30 can also be seen. The latter is mounted on the heel retainer support 3 so as to be rotatable about an axle 31. The axle 31 is located in an upper area of the heel retainer support 3 and, seen in the longitudinal direction of the ski, in front of the actuation lever 7. The climbing aid lever 30 has a tread surface in the front area of its free end. In the walking configuration of the automatic heel unit 1, the climbing aid lever 30 can be pivoted forward with its free end, as is shown in FIG. 7. In this way, the tread surface of the climbing aid lever 30 is pivoted into the path of movement of the ski boot freed from the heel retainer 4, such that the heel area of the ski boot held in the automatic front unit is supported by the climbing aid lever 30 in a movement toward the ski and is prevented from executing a further movement toward the ski. Besides the climbing aid lever 30, the actuation lever 7 can also be used as a climbing aid. For this purpose, as shown in FIGS. 8*a* and 8*b*, the actuation lever 7 can be pivoted forward with its free end into the path of movement of the ski boot, freed from the heel retainer 4, to its second walking position. In this way, the heel area of the ski boot held in the automatic front unit is supported by the actuation lever 7 in a movement toward the ski and is prevented from executing a further movement toward the ski. Since the actuation lever 7 is located farther up than the climbing aid lever 30, the actuation lever 7 supports the ski boot farther away from the ski than does the climbing aid lever 30. It thus forms a higher climbing step than the climbing aid lever 30.

In the release position of the actuation lever 7, in which the free end of the actuation lever 7 faces approximately horizontally toward the rear, the climbing aid lever 30 is also oriented approximately horizontally, as shown in FIGS. 5*a*-5*c*. The climbing aid lever 30 bears with its upper face on an underside of the actuation lever 7. When the actuation lever 7 is adjusted from its release position to its first walking position, the actuation lever 7 carries the climbing aid lever 30 with it, such that, in the first walking position of the actuation lever 7, the free end of the actuation lever 7 and also the free end of the climbing aid lever 30 face vertically upward. The climbing aid lever 30 bears with its upper face on the underside of the actuation lever 7. It is thus located in a deactivated position.

FIG. 8*b*, like FIG. 8*a*, shows the automatic heel unit in the walking configuration, with the actuation lever 7 in the second walking position. In FIG. 8*b*, however, the cross section, seen in the transverse direction of the ski, extends through the side wall of the heel retainer 4 directed toward the observer. It can thus be seen that the cam 17 of the actuation lever 7, in the second walking position of the actuation lever 7, is located at the lower area of the recess 16 of the heel retainer 4. When the actuation lever 7 is adjusted from its first walking position to its second walking position, the cam 17 of the actuation lever 7 moves downward from the front, rounded tip of the recess 16, along the recess 16, into the lower area of the recess 16. The heel retainer 4 is not adjusted thereby; however, the heel retainer 4, in the second walking position of the actuation lever 7, is held down by the cam 17 of the actuation lever 7 and is prevented from executing a rotation movement and an upward movement.

The invention is not limited to the automatic heel unit 1 described above. For example, it is not necessary for the automatic heel unit as described above to comprise a base plate. It is also not necessary that the heel retainer support is mounted directly on an optionally present base plate. For use in a ski-touring binding of the first type mentioned at the outset, the heel retainer support can for example also be arranged, as described in WO 96/23559 A1 (Fritschi AG Apparatebau), on the sole carrier which, in its front area, is pivotable about an axle that is oriented horizontally in the transverse direction of the ski.

Besides the use in ski-touring bindings, Telemark bindings or cross-country ski bindings, an automatic heel unit according to the invention can also be used in other ski bindings, for example in downhill bindings.

Irrespective of the type of ski binding in which the automatic heel unit is used, it is not necessary for the heel retainer support to be pretensioned in a forward direction relative to the base plate. For example, the automatic heel unit can also be designed simply to be movable relative to the base plate so as to be able to adapt a distance between the automatic front unit and the automatic heel unit to a size of a ski boot that is to be retained. For example, there is also the possibility, however, that the heel retainer support is mounted fixedly on the base plate, in which case the heel retainer support and the base plate can also be integrally configured as one element.

However, the invention can also be embodied so as to deviate from the above-described automatic heel unit 1 in other ways. For example, the first area and the second area of the adjustment path can extend other than in a plane oriented vertically in the longitudinal direction of the ski. Moreover, the first area of the adjustment path can also comprise non-linear partial areas. Also, the first area of the adjustment path does not necessarily have to comprise a vertical component. In this case, the first area of the adjustment path leads horizontally toward the rear. There is also the possibility that, although the first area of the adjustment path comprises a vertical component, the heel retainer is not located any farther down in its walking setting than in its holding setting. There is thus also the possibility that the heel retainer is located farther up in its walking setting than in its holding setting, as long as the heel retainer is located farther to the rear in its walking setting than in its holding setting.

Moreover, the automatic heel unit can also have a retaining device other than the described heel retainer. Thus, the heel-supporting structure does not necessarily have to be designed separately from the holding-down structure. Moreover, there is also the possibility that the retaining device comprises no holding-down structure for holding down the heel area of the ski boot, or no heel-supporting structure for supporting the heel area of the ski boot in a direction horizontally transverse to the ski.

Moreover, an elastic element other than the spring 20 can be used in the automatic heel unit. The transmission of force from the elastic element to the heel retainer can also be effected other than via a detent.

The bearing of the heel retainer on the heel retainer support can also be configured differently. Instead of having four bearing points, the heel retainer can for example be mounted on the heel retainer support via just one bearing point. Moreover, the automatic heel unit does not necessarily need to have a heel retainer guide, and the automatic heel unit also does not necessarily need to have an actuation lever guide. Furthermore, the actuation lever does not necessarily need to be mounted rotatably on the heel retainer support.

There is also the possibility that the ski brake is arranged not on the base plate but instead on the heel retainer support, or on another element of the automatic heel unit. There is also the possibility that the automatic heel unit is configured without a ski brake.

It can be stated in summary that an automatic heel unit is made available which has a walking configuration in which the automatic heel unit adopts a compact configuration.

The invention claimed is:

1. Automatic heel unit for a ski binding, in particular a ski-touring binding, comprising a heel retainer, for retaining a ski boot in a heel area of the ski boot, and a heel retainer support on which the heel retainer is mounted so as to be movable along an adjustment path relative to the heel retainer support, wherein a) the automatic heel unit has a holding configuration in which the heel retainer is located in a holding setting and the heel retainer can interact with the heel area of the ski boot held in the ski binding in such a way that the heel area of the ski boot is held in a lowered position, and wherein b) the automatic heel unit has a walking configuration in which the heel retainer is located in a walking setting and the heel area of the ski boot held in the ski binding is freed from the heel retainer and can be lowered toward the ski without being locked by the heel retainer in the lowered position, wherein the heel retainer in its walking setting is located farther to the rear than in its holding setting and is movable from its walking setting to its holding setting and back again along a first area of the adjustment path and, starting from its walking setting, the heel retainer is movable along the first area of the adjustment path, beyond its holding setting, upward from the first area of the adjustment path into a second area of the adjustment path separate from the first area of the adjustment path and adjoining the first area of the adjustment path, and back again.

2. Automatic heel unit according to claim 1, wherein the first area of the adjustment path comprises a vertical component.

3. Automatic heel unit according to claim 1, wherein the heel retainer in its walking setting is located farther down than in its holding setting.

4. Automatic heel unit according to claim 1, wherein the first area of the adjustment path is substantially linear.

5. Automatic heel unit according to claim 1, further comprising an elastic element with which the heel retainer is pretensioned toward its holding setting, at least in a partial area of the second area of the adjustment path adjoining the first area of the adjustment path.

6. Automatic heel unit according to claim 5, wherein, at each position of the heel retainer in the partial area of the second area of the adjustment path, a force generated by the elastic element is oriented at an acute angle to an orientation of the second area of the adjustment path at the respective position of the heel retainer.

7. Automatic heel unit according to claim 1, wherein the heel retainer is freely movable along the first area of the adjustment path.

8. Automatic heel unit according to claim 1, further comprising a base element for mounting the automatic heel unit on an upper face of a ski, wherein the heel retainer support is arranged on the base element.

9. Automatic heel unit according to claim 1, wherein the heel retainer has a holding-down structure by which the heel area of the ski boot held in the ski binding is maintained in the lowered position in the holding configuration of the automatic heel unit.

10. Automatic heel unit according to claim 1, wherein the automatic heel unit has a release configuration in which the heel retainer is located in a release setting and the heel area of the ski boot is freed from the heel retainer.

11. Automatic heel unit according to claim 10, wherein the heel retainer is movable from its holding setting to its release setting and back again along the second area of the adjustment path.

12. Automatic heel unit according to claim 1, further comprising a heel retainer guide with which the heel retainer is mounted on the heel retainer support so as to be movable relative to the heel retainer support, along the first area of the adjustment path, from its holding setting to its walking setting and back again.

13. Automatic heel unit according to claim 12, wherein the heel retainer support comprises a groove, which forms a constituent part of the heel retainer guide.

14. Automatic heel unit according to claim 1, wherein the automatic heel unit comprises an actuation lever which, when actuated, allows the automatic heel unit to be adjusted from the holding configuration to the walking configuration and back again.

15. Automatic heel unit according to claim 14, further comprising an actuation lever guide for transmitting a movement of the actuation lever to the heel retainer.

16. Automatic heel unit according to claim 1, wherein the automatic heel unit permits a safety release.

17. Automatic heel unit according to claim 1, further comprising a ski brake which is adjustable between a braking setting and a travel setting and which is movable in translation relative to the heel retainer support.

18. Automatic heel unit according to claim 17, wherein the ski brake is coupled to the heel retainer of the automatic heel unit, as a result of which a movement of the heel retainer along the adjustment path relative to the heel retainer support is transmittable to a movement of the ski brake relative to the heel retainer support.

* * * * *